US008898871B2

(12) United States Patent
Nakamura et al.

(10) Patent No.: US 8,898,871 B2
(45) Date of Patent: Dec. 2, 2014

(54) OPERATION CORD, AND OPERATION APPARATUS FOR SUNLIGHT SHIELDING APPARATUS

(75) Inventors: Hajime Nakamura, Tokyo (JP); Seiya Abo, Chiba (JP); Eiji Kawai, Tokyo (JP); Masaya Yamaguchi, Tokyo (JP); Shojiro Uehara, Tokyo (JP)

(73) Assignee: Tachikawa Corporation, Tokyo (JP)

( * ) Notice: Subject to any disclaimer, the term of this patent is extended or adjusted under 35 U.S.C. 154(b) by 0 days.

(21) Appl. No.: 13/643,809

(22) PCT Filed: Apr. 27, 2011

(86) PCT No.: PCT/JP2011/060227

§ 371 (c)(1),
(2), (4) Date: Oct. 26, 2012

(87) PCT Pub. No.: WO2011/136255

PCT Pub. Date: Nov. 3, 2011

(65) Prior Publication Data

US 2013/0037226 A1 Feb. 14, 2013

(30) Foreign Application Priority Data

Apr. 30, 2010 (JP) ..... 2010-105881
Apr. 30, 2010 (JP) ..... 2010-105883
Apr. 30, 2010 (JP) ..... 2010-105928

(51) Int. Cl.

| | |
|---|---|
| ***A41F 1/00*** | (2006.01) |
| ***E06B 9/326*** | (2006.01) |
| ***E06B 9/38*** | (2006.01) |
| ***E06B 9/42*** | (2006.01) |
| *E04F 10/06* | (2006.01) |
| *E06B 9/303* | (2006.01) |
| *E06B 9/262* | (2006.01) |

(52) U.S. Cl.

CPC . *E06B 9/326* (2013.01); *E06B 9/38* (2013.01); *E06B 9/42* (2013.01); *E04F 10/06* (2013.01); *E06B 9/303* (2013.01); *E06B 2009/2625* (2013.01); *E06B 2009/3265* (2013.01)

USPC ..... 24/663; 160/321; 160/173 R

(58) Field of Classification Search

CPC ..... E06B 9/326; A44C 5/185
USPC ..... 160/84.04, 84.05, 168.1 R, 173 R, 321; 24/663

See application file for complete search history.

(56) References Cited

U.S. PATENT DOCUMENTS 5,411,445 A * 5/1995 Oda ..... 474/154
5,634,244 A * 6/1997 Fetsch et al. ..... 24/115 F (Continued)

FOREIGN PATENT DOCUMENTS

EP 0565379 A1 10/1993
EP 1026422 A1 8/2000

(Continued)

OTHER PUBLICATIONS

Machine translation of JP 2003184456 A.*

(Continued)

*Primary Examiner* — Katherine Mitchell
*Assistant Examiner* — Scott Denion
(74) *Attorney, Agent, or Firm* — Maier & Maier, PLLC

(57) ABSTRACT

Provided is an endless operation cord that is easy to replace. The present invention provides an operation cord including: a main cord having one and the other ends; a first coupling part disposed at the one end; and a second coupling part disposed at the other end. The first and second coupling parts can be coupled together directly or via a coupling member and can be coupled or uncoupled by means of a relative rotation between the adjacent coupling parts or between the adjacent coupling parts and coupling member or a relative movement in a direction other than a length direction of the main cord between the adjacent coupling parts or between the adjacent coupling parts and coupling member.

12 Claims, 32 Drawing Sheets

(56) References Cited

U.S. PATENT DOCUMENTS

| | | | | |
|---|---|---|---|---|
| 6,250,359 | B1 | 6/2001 | Lorio et al. | |
| 2003/0154742 | A1* | 8/2003 | Ooide | 63/38 |
| 2008/0219604 | A1* | 9/2008 | Chen et al. | 384/43 |
| 2011/0194895 | A1* | 8/2011 | Lai | 403/361 |

FOREIGN PATENT DOCUMENTS

| | | | | | |
|---|---|---|---|---|---|
| GB | 2188261 | A | | 9/1987 | |
| JP | 39-023680 | Y | | 8/1964 | |
| JP | 62-045025 | Y | | 11/1987 | |
| JP | 05-295642 | A | | 11/1993 | |
| JP | 06-146753 | A | | 5/1994 | |
| JP | 06-217857 | A | | 8/1994 | |
| JP | 07-204018 | A | | 8/1995 | |
| JP | 09-189180 | A | | 7/1997 | |
| JP | 09-268486 | A | | 10/1997 | |
| JP | 10-137016 | A | | 5/1998 | |
| JP | 2001-275723 | A | | 10/2001 | |
| JP | 2003-184456 | A | | 7/2003 | |
| JP | 2005-299379 | A | | 10/2005 | |
| JP | 2006-255152 | A | | 9/2006 | |
| JP | 2008-002193 | A | | 1/2008 | |
| JP | 2003184456 | A | * | 7/2013 | E06B 9/326 |
| WO | WO 2010150799 | A1 | * | 11/2011 | F16G 13/12 |

OTHER PUBLICATIONS

JP 20082193 Machine Translation.*

International Search Report mailed Aug. 16, 2012, as issued in International Patent Application No. PCT/JP2010/060227, filed Apr. 27, 2011.

Corresponding JP patent application No. 2010-105928 Office Action issued Jan. 28, 2014.

Extended European Search Report dated Jul. 9, 2014 in corresponding EP application No. 11775036.4.

* cited by examiner

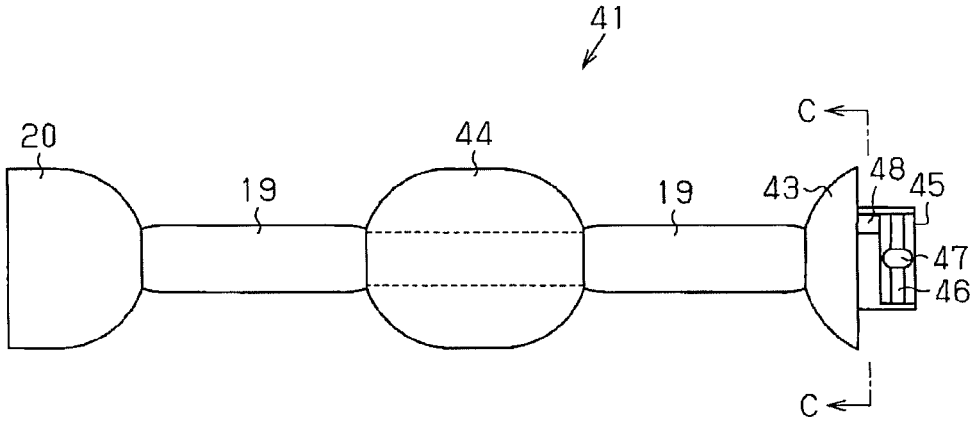
Fig. 16
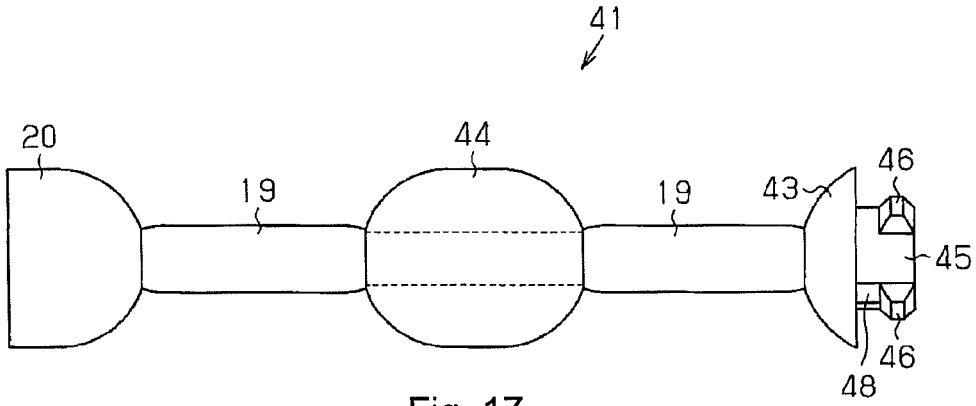
Fig. 17
Fig. 18
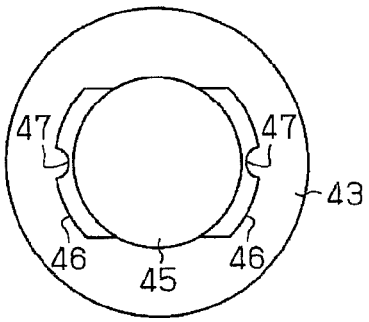

OPERATION CORD, AND OPERATION APPARATUS FOR SUNLIGHT SHIELDING APPARATUS

RELATED APPLICATIONS

This is the U.S. national stage application which claims priority under 35 U.S.C. §371 to International Patent Application No.: PCT/JP2011/060227 filed on Apr. 27, 2011, which claims priority to Japanese Patent Application Nos. 2010-105928 filed on Apr. 30, 2010, 2010-105883, filed on Apr. 30, 2010, and 2010-105881 filed on Apr. 30, 2010 the disclosures of which are incorporated by reference herein their entireties.

TECHNICAL FIELD

The present invention relates to an operation cord that is suitably used in a horizontal blind, a vertical blind, a shade, a screen window, an up-down sliding window, an awning, a skylight window, a laundry pole, and other apparatuses, and an operation apparatus for operating a shielding material of a sunlight shielding apparatus, such as a horizontal blind, pleated screen, or tuck-up curtain.

BACKGROUND ART (1) Operation Cord

There is a type of horizontal blind where an endless operation cord is engaged with a pulley which is rotatably supported by an edge of a head box. When operating the operation cord to rotate the pulley, a force is transmitted to a slat drive mechanism in the head box. Thus, it is possible to perform a slat elevation operation and a slat angle adjustment operation. There is also known a technology of operating a vertical blind by rotating an operation cord around a pulley. An operation cord is also used in apparatuses using a windup-type insect screen in place of a sunlight shielding material, elevation apparatuses for up/down window, and elevation apparatuses for laundry pole or the like.

Such an operation cord is an endless cord formed by welding or swaging both ends of a cord which is formed of a synthetic resin in the form of a string (for example, see Patent Documents 1 to 3). As described in Patent Document 4, by engaging such an operation cord with recesses formed on the peripheral surface of a pulley inside a pulley case that houses the pulley, the pulley can be rotationally driven.

(2) Ball Chain

A ball chain may be used as an example of an operation cord.

A ball chain is formed, for example, by molding synthetic-resin balls on a string-shaped, synthetic-resin cord at regular intervals and fixing the balls to the cord. By sequentially engaging the balls with recesses formed on the peripheral surface of a pulley, the pulley can be rotationally driven.

Such a ball chain typically has an endless structure where both ends of a cord having many molded balls attached thereto are coupled together via a connector. For a horizontal blind, where a slat up/down operation is performed by rotating a ball chain about a pulley one or more times, the shape of balls on a ball chain coupling portion and the interval between the balls must be the same as those on other portions.

In such a case, there is proposed a ball chain where a ball on a coupling portion is divided into two portions and the divided portions are fitted with each other to form a ball. (See Patent Document 5)

Where an endless ball chain is suspended from a pulley as described above, the endless edge of the ball chain may be caught on a dweller or another mobile object moving in the room.

For this reason, a coupling portion included in an endless ball chain needs to have a fail-safe function of, when an excessive pull force exceeding a pull force applied in a normal operation is applied to the coupling portion, cutting the coupling portion by means by the pull force to ensure the safety of the dweller and prevent damage to such as the pulley with which the ball chain is engaged. Such a fail-safe function can release the ball chain caught on the dweller or the like to allow the dweller or the like to move, as well as to prevent damage to such as the pulley or the like with which the ball chain is engaged.

PRIOR ART DOCUMENTS

Patent Documents

Patent Document 1: Japanese Unexamined Utility Model Application Publication No. 62-45025

Patent Document 2: Japanese Patent No. 2782508

Patent Document 3: Japanese Unexamined Utility Model Application Publication No. 39-23680

Patent Document 4: Japanese Patent No. 2744563

Patent Document 5: Japanese Unexamined Patent Application Publication No. 2003-184456

SUMMARY OF THE INVENTION

Problems to be Solved by the Invention (1) Operation Cord

For a firmly fixed, endless operation cord as described above, detaching it from the blind requires cutting it or releasing the swaged portion. Accordingly, it is not easy to detach the operation cord once and then reattach it to the blind to use.

The object of a first aspect of the present invention is to provide an endless operation cord that is easy to replace.

(2) Ball Chain

Where the divided portions of a ball chain as described above are fitted with each other to form a coupling portion, providing the coupling portion with a sufficient holding force requires fitting the coupling portion by a press force which is not smaller than the holding force. Such fitting requires a predetermined tool. Accordingly, it is not easy to recouple the coupling portion which has been cut by an excessive pull force.

The object of a second aspect of the present invention is to provide a cord coupling portion that can reliably couple the cord with a slight operation force and in such a manner that the coupling can be checked, as well as can obtain a sufficient holding force.

A ball chain as described above is formed so that the pitch between balls included in the ball chain is approximately the same as that between recesses and protrusions of the pulley with which the ball chain is engaged. Thus, the balls of the hall chain smoothly engage with the pulley.

However, when the coupling portion of the ball chain engages with a pulley, the balls of the coupling portion and balls preceding or following the balls engage with the recesses of the pulley. Thus, a pull force is applied to the coupling portion in a direction of separating the coupling portion, detaching the coupling portion.

When the ball chain is cut with in a state where the coupling portion is not engaged with the pulley, it is easy to recouple the coupling portion to restore the ball chain to an endless state. However, when the ball chain is detached in a state where the coupling portion engages with the pulley, the ball chain is dropped out of the pulley. This cause a problem that bothersome tasks are required to engage the ball chain with the pulley again and restore the ball chain into an endless state.

The object of a third aspect of the present invention is to provide an operation apparatus for a sunlight shielding apparatus that, when the coupling portion of a ball chain is engaged with a pulley during a normal operation, can prevent detachment of the coupling portion.

That is, the object of the present invention is to provide an operation cord that can easily be coupled and uncoupled, and an operation apparatus for a sunlight shielding apparatus including such an operation cord.

Means for Solving the Problems

The above-mentioned problem can be solved by at least one of the first to third aspects of the present invention. The features of the first to third aspects described below can be combined, and combining them allows more favorable effects to be obtained.

(First Aspect of Present Invention)

According to a first aspect of the present invention, an operation cord is provided. The operation cord includes: a main cord having one and the other ends; a first coupling part disposed at the one end; and a second coupling part disposed at the other end. The first and second coupling parts can be coupled together directly or via a coupling member and can be coupled or uncoupled by means of a relative rotation between the adjacent coupling parts or between the adjacent coupling parts and coupling member or a relative movement in a direction other than a length direction of the main cord between the adjacent coupling parts or between the adjacent coupling parts and coupling member.

During use, the operation cord of the first aspect of the present invention can be used as an endless operation cord by coupling the first and second coupling parts together. During non-use or during exchange of the operation cord, it can be unlooped by releasing the coupling between the first and second coupling parts by means of a relative rotation between the adjacent coupling parts or between the adjacent coupling parts and coupling member or a relative movement in a direction other than a length direction of the main cord between the adjacent coupling parts or between the adjacent coupling parts and coupling member. The expression "between the adjacent coupling portions or between the adjacent coupling parts and coupling member refers to between the first and second coupling parts when the first and second coupling parts are directly coupled together; it refers to between the first coupling part and the coupling member or between the second coupling part and the coupling member when the first and second coupling parts are coupled together via the coupling member.

According to the first aspect of the present invention (1) During nonuse of the operation cord, an accident can be prevented by releasing the coupling between the coupling parts to unloop the operation cord; (2) the operation cord can be detached from the blind or the like without having to cut the operation cord; and (3) the operation cord can be easily replaced with another.

Operation cords are known which when is divided and unlooped when abrupt shock is given to the operation cord in the length direction thereof (for example, JP-A-2003-184456). However, the present invention differs from such operation cords in the following points.

(1) The object of the first aspect of the present invention is to solve various problems of an endless operation cord by easily looping or unlooping the operation cord. On the other hand, the object of the known invention is to ensure the safety by unlooping an operation cord when abrupt shock is given to the operation cord. Therefore, both differ from each other in basic object (note that the operation cord of the present invention can be also configured so that the operation cord is divided and unlooped when abrupt shock is given to the operation cord in the length direction thereof, although this configuration is not essential).

(2) The direction of a force applied to the operation cord of the present invention when looping or unlooping it differs from the length direction of the operation cord. Accordingly, the magnitude of a force for looping or unlooping the operation cord may be smaller than a force applied to the operation cord in a normal operation (referred to as "operation force"). As a result, the operation cord can be looped or unlooped even at home without having to use a special jig. On the other hand, the above-mentioned known invention resiliently fits the fitting protrusion and fitting hole formed at both ends of the operation cord with each other. Accordingly, the direction of a looping or unlooping force agrees to the length direction of the operation cord. In this case, the magnitude of the looping or unlooping force needs to be larger than the operation force. The reason is that a looping or unlooping force smaller than the operation force allows the operation cord to be unlooped during a normal operation. However, if the looping or unlooping force is large, it is difficult to loop the operation cord without using a jig. Accordingly, it is difficult for the above-mentioned known invention to loop the operation cord at home.

Hereafter, various embodiments of the first aspect of the present invention will be described. Various embodiments described below can be combined.

In an example, the first coupling part includes an axial fitting protrusion, the second coupling part has a fitting hole into which the fitting protrusion can be fitted, and the fitting protrusion can be fitted into the fitting hole by inserting the fitting protrusion into the fitting hole and then rotating the fitting protrusion.

In an example, the fitting protrusion includes a swelled portion having a diameter larger than a diameter of a base end thereof, and the fitting hole is provided with a locking portion configured to engage with the swelled portion.

In an example, the swelled portion and the inner peripheral surface of the fitting hole are provided with positioning means configured to determine the rotation position of the fitting protrusion.

In an example, the position at which the fitting protrusion is fitted into the fitting hole is a position to which the fitting protrusion is brought through a rotation by 90 degrees after inserted in the fitting hole.

In an example, the first coupling part has a fitting hole, the second coupling part includes a fitting protrusion which can be fitted into the fitting hole, and the fitting hole is configured so that the fitting protrusion can be inserted into the fitting hole in a direction perpendicular to an axis of the main cord.

In an example, the fitting protrusion is axial, the fitting hole has a diameter which allows the fitting protrusion to be inserted into the fitting hole, as well as an open groove which allows the fitting protrusion to be pulled out in the axis direction of the main cord, and the width of the open groove is narrower than the diameter of the fitting protrusion.

In an example, one or both of the first and second coupling parts have a color different from that of the main cord.

In an example, the first and second coupling parts can be coupled together via the coupling member, the first and second coupling parts each have an axial fitting protrusion, the coupling member has a tubular shape which allows the fitting protrusions to be fitted with each other as opposed to each other, the fitting protrusions each have, at a front end thereof, a swelled portion having a diameter larger than a diameter of a base end thereof, and the coupling member is provided with a locking portion configured to engage with the swelled portion when the swelled portion is inserted and rotated.

In an example, the swelled portion and the inner peripheral surface of the coupling member are provided with positioning means configured to determine the rotation position of the fitting protrusion.

In an example, the fitting angle at which the pair of fitting protrusions are fitted into the coupling member is relatively shifted.

In an example, the fitting angle is an angle such that the center lines of the fitting protrusions intersect each other at a right angle.

In an example, the fitting protrusion is outsert-molded on the main cord.

In an example, the fitting protrusion is a solid body.

In an example, first and second coupling parts can be coupled together via a coupling member, the first and second coupling parts each have a fitting hole, the coupling member includes a pair of fitting protrusions which can be inserted into the fitting holes and a shaft for coupling the fitting protrusions, and the fitting hole is configured so that the fitting protrusion can be inserted into the fitting hole in a direction perpendicular to the axis of the main cord.

In an example, the fitting protrusion is axial, the fitting hole has a diameter which allows the fitting protrusion to be inserted into the fitting hole, as well as an open groove which allows the fitting protrusion to be pulled out in an axis direction of the main cord, and the width of the open groove is narrower than the diameter of the fitting protrusion.

In an example, the coupling member has a color different from that of the main cord.

In an example, balls formed of a synthetic resin are disposed at regular intervals on the main cord.

In an example, the main cord is provided with hemispheroids at both ends thereof, a first coupling part includes a first coupling member including a hemispheroid, a second coupling part includes a second coupling member including a hemispheroid, and the first and second coupling members are fixed to the main cord by fixing the hemispheroids thereof to the hemispheroids at both ends of the main cord.

In an example, a first coupling part includes a first coupling member including a coupling cord, a second coupling part includes a second coupling member including a coupling cord, and the first and second coupling members are fixed to the main cord by inserting the coupling cords into axes of both ends of the main cord and sewing the coupling cords.

In an example the first and second coupling parts are formed so that outer diameters thereof in a transverse direction are equal to or smaller than the maximum diameter of the main cord.

In an example, the main cord is formed so that diameters closer to both ends become smaller.

In an example, the main cord is provided with flanges at both ends thereof, and the first and second coupling parts include first and second coupling members, respectively, each coupling member including a locking portion configured to engage with the flange.

In an example, the main cord is provided with balls at both ends thereof, and the first and second coupling parts include first and second coupling members, respectively, each coupling member including a locking portion configured to engage with the ball.

In an example, the first and second coupling members each have an external dimension larger than an interval between a pulley and a pulley case.

(Second Aspect of Present Invention)

According to a second aspect of the present invention, an operation cord is provided. In the cord whose both ends are coupled together via a coupling portion, the coupling portion includes a first coupling member including an axial fitting protrusion and a second coupling member having a fitting hole into which the fitting protrusion can be fitted, the fitting protrusion can be fitted into the fitting hole by inserting the fitting protrusion into the fitting hole and then rotating the fitting protrusion, and the first coupling member is provided with indication means configured to indicate that the fitting protrusion is fitted into the fitting hole.

In an example, the first and second coupling members are molded from a synthetic resin, the second coupling member is formed in the form of a tube into which the fitting protrusions of the first coupling members forming a pair can be fitted from both sides of the tube, the first and second coupling members are each provided with positioning means configured to position the fitting protrusion at a fitting position, and the first coupling members are provided with fitting marks as the indication means, the fitting marks being positioned so as to be opposed to each other in a positioning operation using the positioning means.

In an example, the fitting marks are recesses formed near contact surfaces between the first and second coupling members on the outer peripheral surfaces of the first coupling members.

In an example, the first coupling member is positioned at the fitting position with respect to the second coupling member by rotating the first coupling member clockwise.

In an example, the first and second coupling members are molded from a synthetic resin, the first and second coupling members are each provided with positioning means configured to position the fitting protrusion at a fitting position, and the first and second coupling members are provided with fitting marks, respectively, as the indication means, the fitting marks being positioned so as to be opposed to each other in a positioning operation using the positioning means.

In an example, the fitting marks are recesses formed near contact surfaces between the first and second coupling members on the outer peripheral surfaces of the first and second coupling members.

According to the second aspect of the present invention, it is possible to provide a cord coupling portion that can couple the cord reliably with a slight operation force in a manner where checking is possible as well as can obtain a sufficient holding force.

(Third Aspect of Present Invention)

According to a third aspect of the present invention, an operation apparatus for a sunlight shielding apparatus is provided. In the sunlight shielding apparatus, an endless operation cord is suspended from a pulley which is rotatably supported by a head box; and the pulley is rotated on the basis of an operation of the operation cord to drive a shading material. The ball chain is an endless ball chain coupled via a coupling ball having a fail-safe function, and a pitch between the coupling ball and a ball adjacent to the coupling ball is larger than a pitch between other balls.

In an example, a pitch between a recess and a protrusion of the pulley is the same as a pitch between balls of the ball chain, and a pitch between the coupling ball and a ball adjacent to the coupling ball is larger than a pitch between other balls.

In an example, the pitch between the coupling ball and the ball adjacent to the coupling ball is made larger than the pitch between the other balls by increasing a diameter of the coupling ball.

In an example, the pitch between the coupling ball and the ball adjacent to the coupling ball is made larger than the pitch between the other balls by increasing a length of a coupling cord coupling the coupling ball and the ball adjacent to the coupling ball.

In an example, the pitch between the coupling ball and the ball adjacent to the coupling ball is made larger than the pitch between the other balls by increasing a diameter of the coupling ball and increasing a length of a coupling cord coupling the coupling ball and the ball adjacent to the coupling ball.

According to the third aspect of the present invention, an operation apparatus for a sunlight shielding apparatus can be provided that when the coupling portion of a ball chain engages with a pulley, can prevent uncoupling of the coupling portion.

BRIEF DESCRIPTION OF DRAWINGS

FIG. 16 is a front view showing a first coupling member of the second embodiment of the first aspect;

FIG. 17 is a front view showing the first coupling member of the second embodiment of the first aspect;

FIG. 18 is a side view showing the first coupling member of the second embodiment of the first aspect;

MODES FOR CARRYING OUT THE INVENTION

Figure 1:
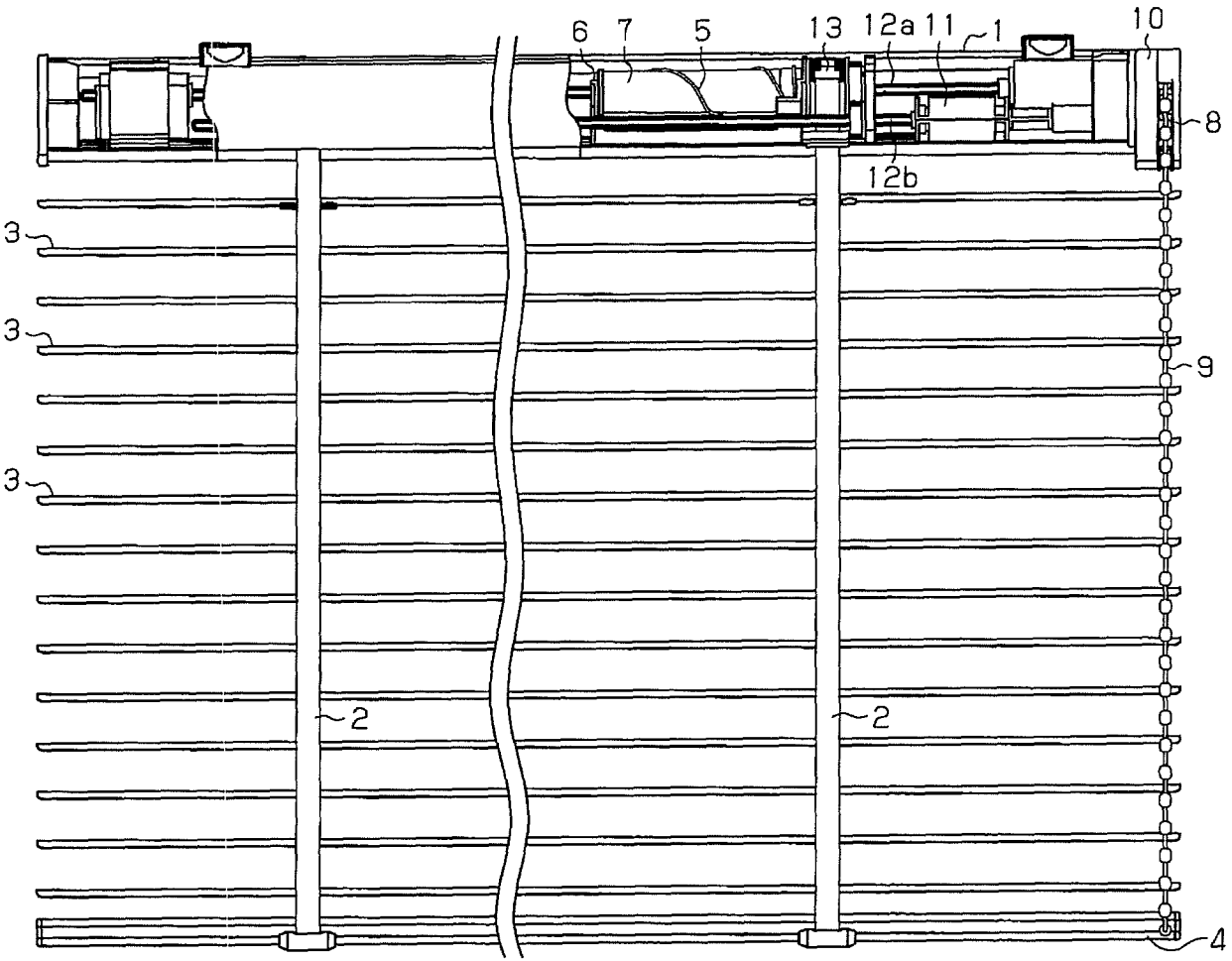
FIG. 1 is a front view showing a horizontal blind of a first embodiment of a first aspect.

Hereafter, various embodiments of the present invention will be described. While embodiments based on first to third aspects of the present invention will be described for the sake of convenience, embodiments including two or more features of the first to third embodiments are also possible. Accordingly, the embodiments based on the first to third aspects of the present invention described below can be combined. For numerals given to elements, the same numerals may be given to different elements in different embodiments.

First Embodiment of First Aspect

Hereafter, a first embodiment of the first aspect of the present invention will be described with reference to FIGS. 1 to 10.

In this embodiment, an "operation cord" of the claims is a ball chain 9; a "first coupling part" includes a first coupling member 27 including a hemispheroid 20; and a "second coupling part" includes a second coupling member 28 including a hemispheroid 24. Balls 15 of a synthetic resin are disposed on a main cord 14 at regular intervals. The first coupling member 27 and the second coupling member 28 are fixed to the main cord 14 by fixing the hemispheroids 20, 24 to hemispheroids 15*a* at both ends of the main cord 14.

Hereafter, this embodiment will be described in more detail.

In a horizontal blind shown in FIG. 1, multiple slats 3 are supported by ladder tapes 2 which are suspended and supported by a head box 1, and a bottom rail 4 is attached to the bottom ends of the ladder tapes 2

Hoisting cords 5 are inserted into the slats 3 near the positions at which the slats 3 are supported by the ladder tapes 2, and the bottom rail 4 is suspended and supported by the bottom ends of the hoisting cords 5. The top ends of the hoisting cords 5 are wound around a winding shaft 7 which is rotatably supported by a supporting member 6 disposed in the head box 1.

A pulley 8 is rotatably supported by an end of the head box 1, and an endless ball chain 9 is engaged with the pulley 8. Rotations of the pulley 8 in a forward or reverse direction made by operating the ball chain 9 are transmitted to the winding shaft 7 via a gear box 10, a hoisting shaft 12*a*, and the like. Thus, the winding shaft 7 rotates to wind or unwind the hoisting cords 5, raising or lowering the slats 3 and the bottom rail 4.

Further, rotations of the pulley 8 are transmitted to a tilt drum 13 via the gear box 10, a tilt unit 11, a tilt shaft 12*b*, and the like. Thus, the tilt drum 13 makes rotations, which are then transmitted to the slats 3 via the ladder tapes 2 to rotate the slats 3.

Figure 2:
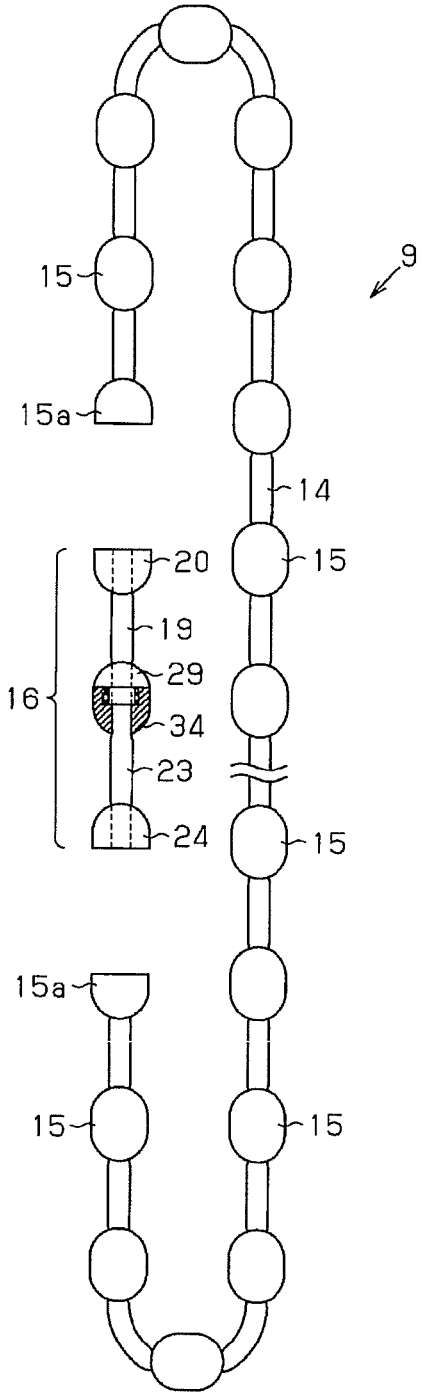
FIG. 2 is a front view showing a ball chain of the first embodiment of the first aspect.

Referring now to FIGS. 2 to 10, the specific configuration of the ball chain 9 will be described. As shown in FIG. 2, in the ball chain 9, balls 15 of a synthetic resin are molded at regular intervals on the main cord 14 of polyester. The balls 15 are prolate spheroidal solid bodies molded on a surface of the main cord 14 by a molding machine and are firmly fixed to the main cord 14 so as to be immovable.

Figure 3:
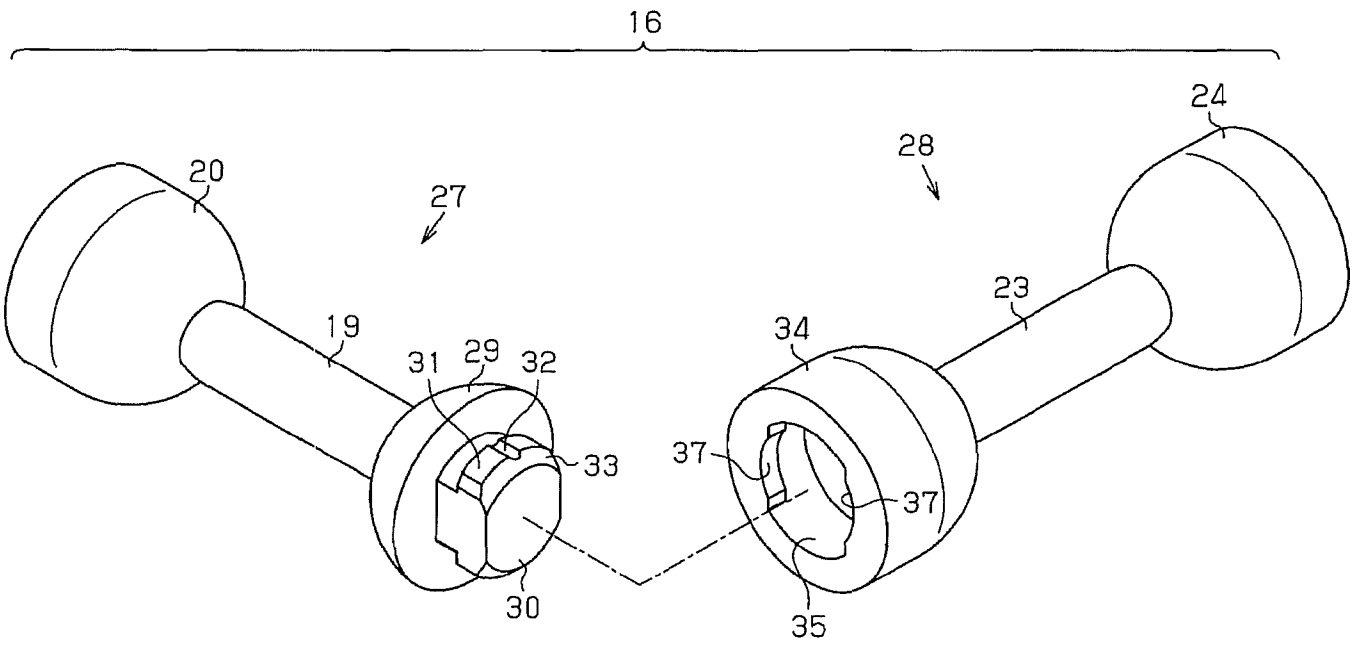
FIG. 3 is an exploded perspective view showing the first embodiment of the first aspect.
Figure 4:
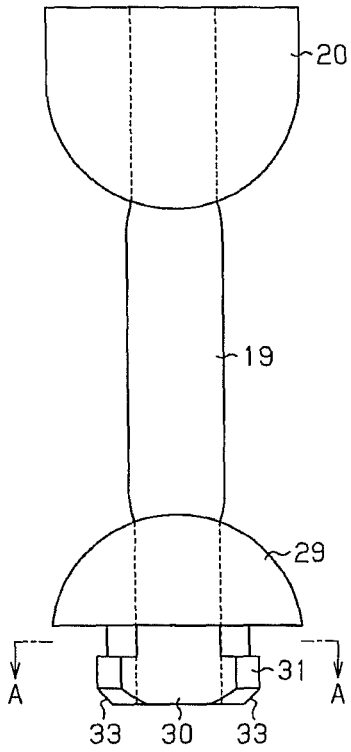
FIG. 4 front showing first member of the first embodiment of the first aspect.

Both ends of the main cord 14 are coupled together by a coupling portion 16 to form the endless ball chain 9. As shown in FIG. 3, the coupling portion 16 is composed of the first coupling member 27 and the second coupling member 28.

In the first coupling member 27, a hemispheroid 20 having a shape of half the ball 15 is outsert-molded at an end of a coupling cord 19 made of the same material as that of the main cord 14, and a first fitting part 29 is formed at the other end thereof. The interval between the hemispheroid 20 and the first fitting part 29 is the same as the interval between the balls 15.

The hemispheroid 20 and the first fitting part 21 are formed of the same material as that of the balls 15 at both ends of the coupling cord 19.

The base end of the first fitting part 29 is formed into a hemispheroid similar to that of the end of the ball 15. Formed at the front end thereof is a fitting protrusion 30 having a bale-shaped cross-section obtained by cutting off both sides of a round shank in parallel.

Figure 5:
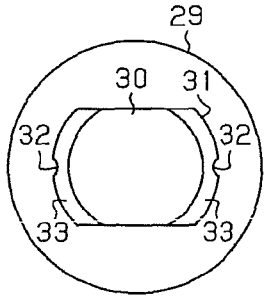
FIG. 5 is a bottom view showing the first coupling member of the first embodiment of the first aspect.
Figure 6:
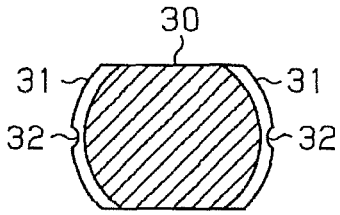
FIG. 6 is a sectional view taken along line A-A of FIG. 4.

As shown in FIGS. 5 and 6, swelled portions 31 formed by expanding the diameter in the long axis direction of the bale shape are formed at edges of the fitting protrusion 30. Troughs 32 are formed on the outer peripheral surfaces of the sides in the long axis direction of the swelled portions 31 in the axis direction of the first fitting part 29. Chamfered edges 33 are formed at corners of the swelled portions 31.

Figure 7:
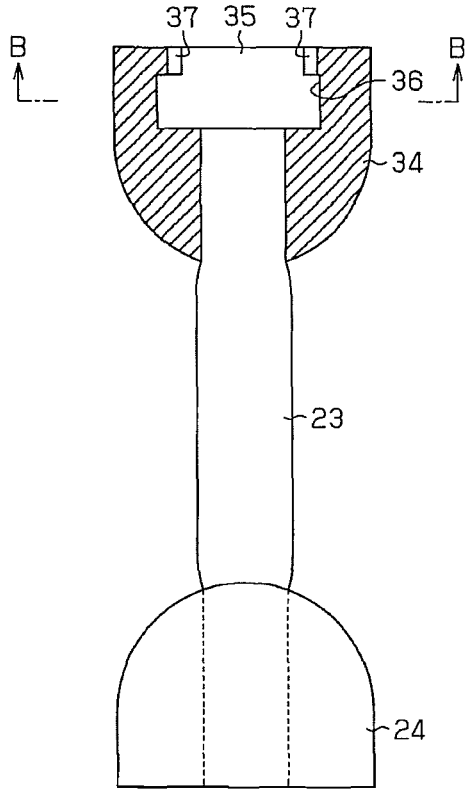
FIG. 7 is a sectional view showing a second coupling member of the first embodiment of the first aspect.

As shown in FIGS. 3 and 7, in the second coupling member 28, a hemispheroid 24 having a shape of half the ball 15 is formed at an end of a coupling cord 23 which is made of the same material as that of the main cord 14, and a second fitting part 34 is formed at the other end. The hemispheroid 24 and the second fitting part 34 are molded from the same synthetic resin as that of the ball 15, and the interval between the hemispheroid 24 and the second fitting part 34 is the same as the interval between the balls 15.

Figure 8:
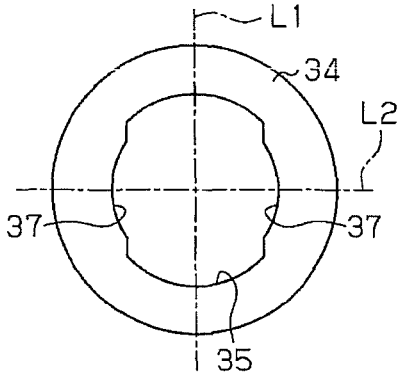
FIG. 8 is a front view showing the second coupling member of the first embodiment of the first aspect.

The base end of the second fitting part 34 is formed into a hemispheroid similar to the end of the ball 15, and a fitting hole 35 is formed at the center of the front end surface of the second fitting part 34. As shown in FIG. 8, the fitting hole 35 has a bale-shaped opening into which the swelled portions 31 of the fitting protrusion 30 can be inserted.

Figure 9:
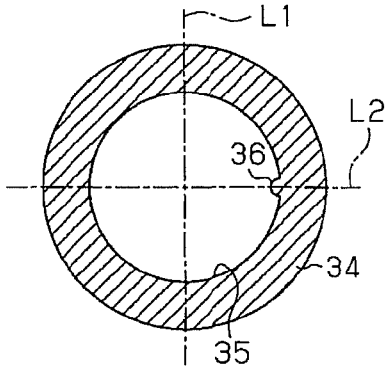
FIG. 9 is a sectional view taken along line B-B of FIG. 7.

As shown in FIGS. 7 and 9, the deep section of the fitting hole 35 is formed into a circle with a diameter which allows the fitting protrusion 30 to rotate within the fitting hole 35. Accordingly, locking portions 37 configured to engage with the swelled portions 31 are formed line-symmetrically in the opening portion of the fitting hole 35. The opening edges of the locking portions 37 are gouged into arcs in order to allow the base end of the fitting protrusion 30 to rotate.

A ridge 36 which can engage with the trough 32 is formed on one side of the inner peripheral surface of the deep section of the fitting hole 35. The ridge 36 is formed on a short axis L2 which intersects a long axis L1 of the opening portion of the fitting hole 35 at a right angle.

Figure 10:
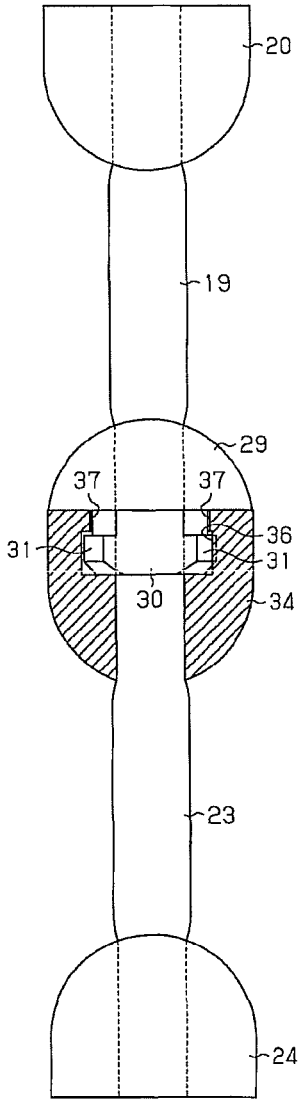
FIG. 10 is a sectional view showing the fit between the coupling members of the first embodiment of the first aspect.

To couple the first fitting part 29 and the second fitting part 34 thus configured, the swelled portion 31 of the fitting protrusion 30 is inserted into the fitting hole 35, and the first fitting part 29 is rotated in either direction in this status. Thus, the trough 32 of the swelled portion 31 engages with the ridge 36 in the fitting hole 35, achieving positioning. As a result, as shown in FIG. 10, the swelled portion 31 is engaged with the locking portion 37 and held within the fitting hole 35.

The force for holding this engagement is set to a magnitude such that the fit between the fitting protrusion 30 and fitting hole 35 is not released by a normal pull force applied to the ball chain 9 in a usual slat up/down operation and a slat angle adjustment operation. Only when a great pull force that exceeds the normal pull force is applied to the ball chain 9, the opening portion of the fitting hole 35 is enlarged by the resiliency of the synthetic resin and thus the swelled portion 31 is pulled out of the fitting hole 35. As a result, the fit between the fitting protrusion 30 and the fitting hole 35 is released.

The first fitting part 29 and the second fitting part 34 are formed so that the external shape thereof is the same as that of the ball 15 in a state where the fitting protrusion 30 is fitted in the fitting hole 35.

The hemispheroids 20, 24 of the first and second coupling members 27, 28 are fixed (welded, bonded, etc.) to the hemispheroids 15*a* which are outsert-molded on both ends of the main cord 14, forming balls each having the same shape as that of the ball 15. When the fitting protrusion 30 is fitted in the fitting hole 35, the endless ball chain 9 is formed.

In the ball chain 9 thus configured, balls having the same shape are formed at regular intervals along the total length of the main cord 14 of the ball chain 9 and the coupling cords 19, 23 of the coupling portion 16. Therefore, the ball chain 9 can rotate around the pulley 8 unlimitedly.

The ball chain thus configured can show the following effects.

(1) Balls having the same shape are formed at regular intervals along the total length of the main cord 14 of the ball chain 9 and the coupling cords 19, 23 of the coupling portion 16. Therefore, it is possible to rotate the ball chain 9 around the pulley 8 unlimitedly to perform a slat up/down operation.

Figure 11:
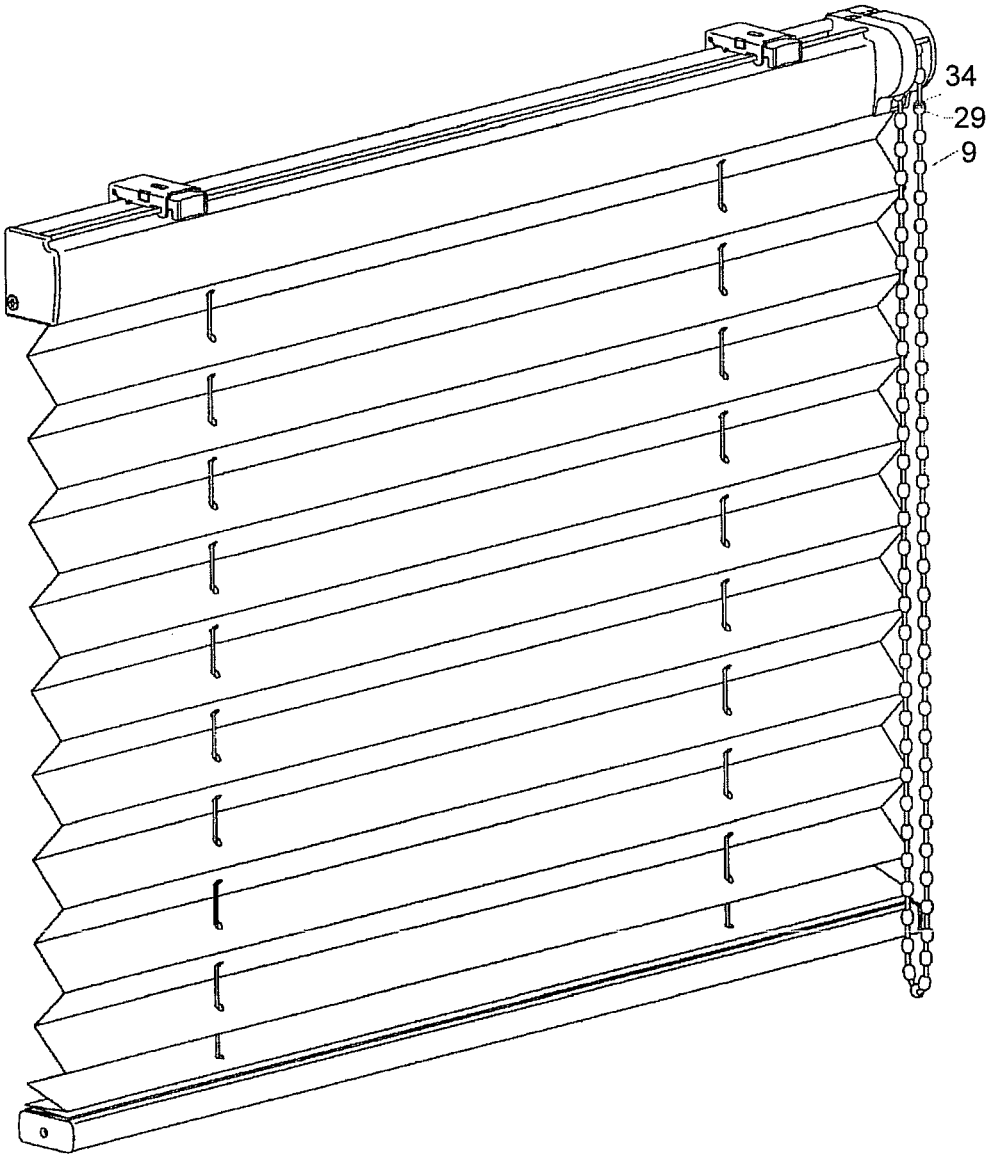
FIG. 11 is a perspective view showing a state where a ball chain of the first embodiment of the first aspect is looped.
Figure 12:
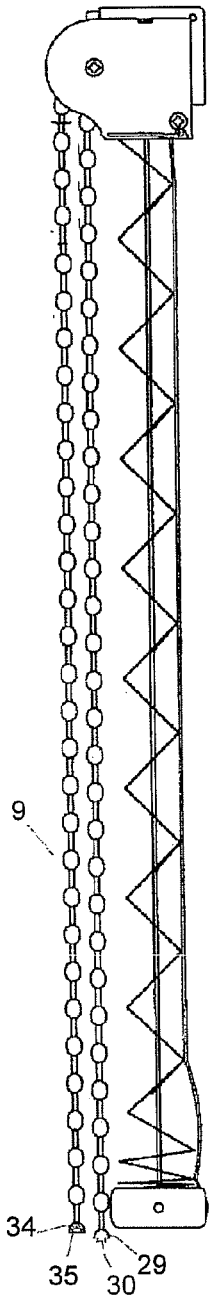
FIG. 12 is a side view showing a state where a ball chain of the first embodiment of the first aspect is unlooped.

(2) As shown in FIG. 11, during use of the blind, the ball chain 9 is used with the first fitting part 29 and the second fitting part 34 fitted with each other, that is, in a as looped manner. As shown in FIG. 12, during nonuse of the blind, the ball chain 9 can be unlooped by releasing the fit between the first fitting part 29 and the second fitting part 34. Thus, the dweller can be prevented from tripping over the ball chain 9 and thus causing an accident.

(3) When replacing the ball chain 9, it is unlooped. Thus, the ball chain 9 can be detached without having to cut it.

(4) When mounting the ball chain 9, it becomes engaged with the pulley in an unlooped state. Thus, the ball chain 9 can be mounted without having to detach the pulley cover or pulley. Note that the pulley cover or pulley may be detached to mount the ball chain 9.

(5) By fitting the fitting protrusion 30 of the coupling portion 16 into the fitting hole 35 again after the fit therebetween is released, the endless ball chain 9 can be reconstructed easily.

(6) A configuration is adopted where the fitting protrusion 30 is fitted into the fitting hole 35 by inserting the swelled portion 31 of the fitting protrusion 30 into the fitting hole 35 and then rotating it by 90 degrees. As a result, it is possible to obtain a sufficient holding force to hold the fitting protrusion 30 within the fitting hole 35 while minimizing the operation force for fitting the fitting protrusion 30 into the fitting hole 35.

(7) Since the operation force for fitting the fitting protrusion 30 into the fitting hole 35 is minimized, it is possible to fit the fitting protrusion 30 into the fitting hole 35 again without using a tool. Therefore, when the coupling portion 16 is uncoupled, the dweller can easily restore the fit.

(8) The chamfered edges 33 provided at the front end of the fitting protrusion 30 allow the fitting protrusion 30 to be easily fitted into the fitting hole 35.

(9) The base end of the fitting protrusion 30 can rotatably be supported by the arc-shaped surfaces of the locking portions 37.

The above embodiment may be carried out in the following mode.

Figure 13:
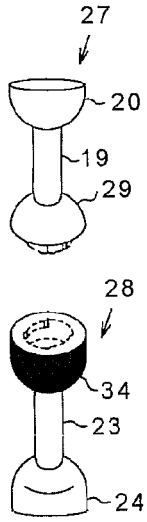
FIG. 13 is a perspective view showing a modification of the coupling portion of the first embodiment of the first aspect.

- The first fitting part 29 and the second fitting part 34 may be formed of a material having rigidity larger than a synthetic resin. In this case, the failsafe function is not obtained. However, even when a great force is applied to the ball chain 9, the ball chain 9 is not unlooped. As a result, the ball chain 9 can be avoided from unexpectedly being unlooped.
- As shown in FIG. 13, the color of the second fitting part 34 may differ from that of the main cord 14 or ball 15. This makes it easy to find the coupling portion 16. Alternatively, the color of the first fitting part 29 may differ from that of the main cord 14 or ball 15, or both colors of the first fitting part 29 and the second fitting part 34 may differ from that of the main cord 14 or ball 15. Alternatively, the colors of the first fitting part 29 and the second fitting part 34 may differ from each other. In this case, by associating the difference between the colors with the difference between the operation directions of the ball chain 9, the pull-up direction or pull-down direction of the blind can be indicated.
- The first fitting part 29 and the second fitting part 34 may be directly outsert-molded at both ends of the main cord 14.
- A similar shape may be formed using methods other than outsert molding.
- The coupling portion 16 may be used as the coupling portion of the endless operation cord for a sunlight shielding apparatus.
- The coupling portion 16 having a fail-safe function may be provided on the intermediate portion of a hoisting cord which is suspended from the head box of a horizontal blind and coupled to the bottom rail, or on the intermediate portion of an operation cord.
- In each embodiment, the areas of the respective contact surfaces between the hemispheroids 15*a* and the hemispheroids 20, 24 may be increased by inclining the contact surfaces with respect to the respective axes of the hemispheroid 15*a* and the hemispheroids 20, 24.

Second Embodiment of First Aspect

Hereafter, a second embodiment of the first aspect of the present invention will be described with reference to FIGS. 14 to 25.

This embodiment is similar to the first embodiment but differs therefrom in the configuration of the coupling portion 16. In this embodiment, an "operation cord" of the claims is a ball chain 9; a "first coupling part" and a "second coupling part" are each composed of a first coupling member 41 including a hemispheroid 20; and the "first coupling part" and the "second coupling part" can be coupled together via a second coupling member 42. The pair of first coupling members 41 are fixed to the main cord 14 by fixing the hemispheroids 20 to the hemispheroids 15*a* at both ends of the main cord 14.

Hereafter, this embodiment will be described in more detail.

Figure 14:
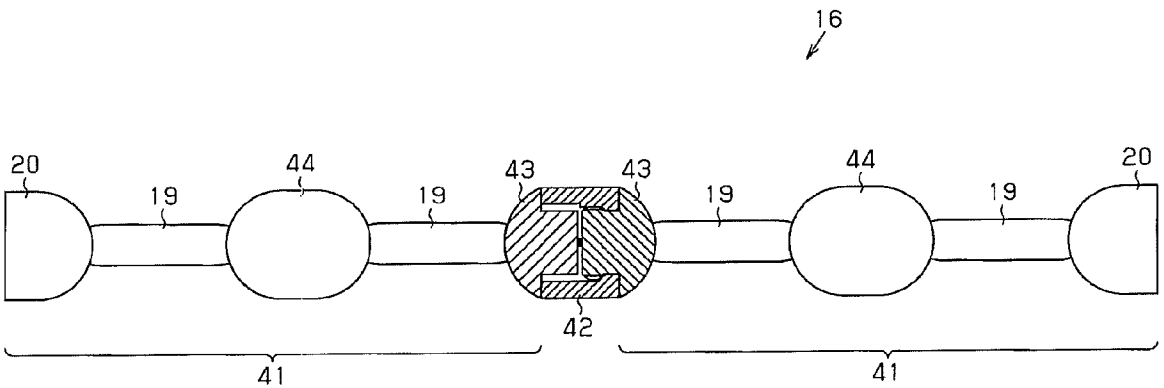
FIG. 14 is a sectional view showing a coupling portion of a second embodiment of the first aspect.
Figure 15:
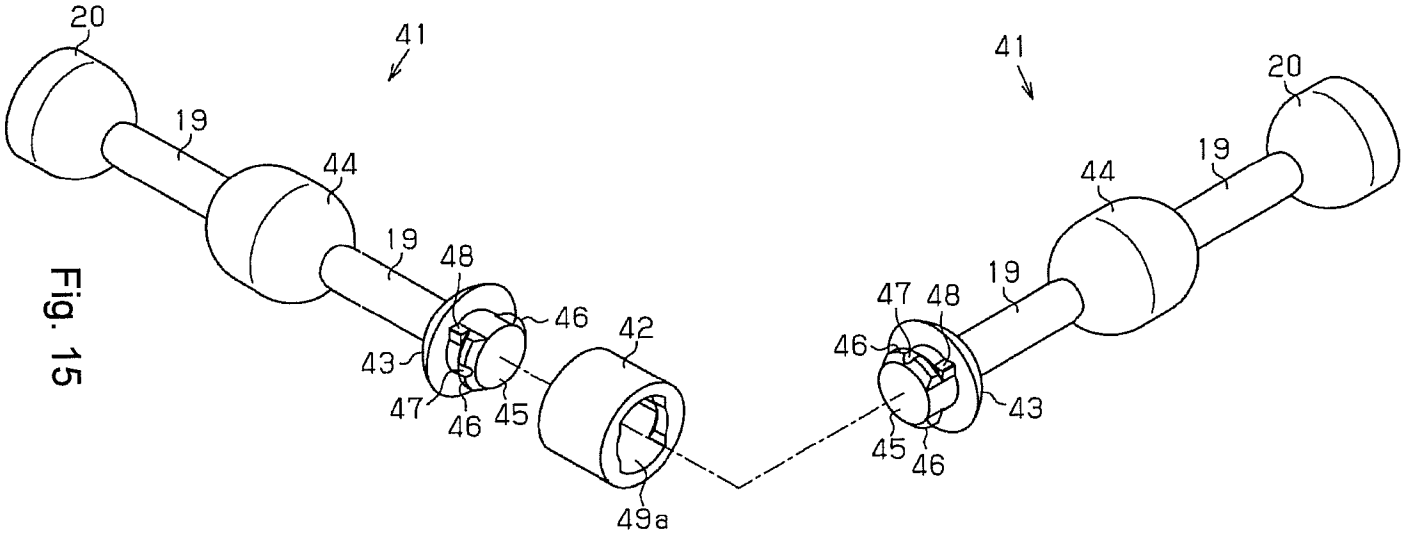
FIG. 15 is an exploded perspective view showing the coupling portion of the second embodiment of the first aspect.

As shown in FIGS. 14 and 15, the coupling portion 16 is configured such that the two first coupling members 41 of the same structure are coupled together via a tubular second coupling member (second fitting part) 42.

As shown in FIG. 16, in the first coupling member 41, the hemispheroid 20 having a shape of half the ball 15 is formed at an end of the coupling cord 19 which is made of the same material as that of the main cord 14, and a first fitting part 43 is formed at the other end. A ball 44 having the same shape as that of the ball 15 is fixed between the hemispheroid 20 and the first fitting part 43. The interval between the first fitting part 43 and the ball 44 and the interval between the ball 44 and the hemispheroid 20 are the same as the interval between the balls 15.

The hemispheroid 20 and the first fitting part 43 are formed of the same material as that of the ball 15 at both ends of the coupling cord 19.

The base end of the first fitting part 43 is formed into a hemispheroid similar to the end of the ball 15. Formed at the front end thereof is a round axial fitting protrusion 45.

As shown in FIGS. 15 to 18, swelled portions 46 are formed on the outer peripheral surface of the front end of the fitting protrusion 45 so as to be line-symmetrical with respect to the center of the round shank. Formed in the middle of each swelled portion 46 is a trough 47 having a semicircular cross-section.

Figure 19:
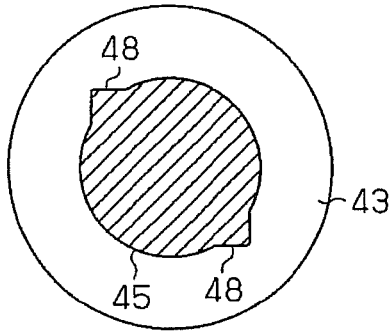
FIG. 19 is a sectional view taken along line C-C of FIG. 16.

As shown in FIGS. 15 and 19, rotation-restriction portions 48 protruding in radial directions of the round shank are formed at the base end of the fitting protrusion 45 so as to be line-symmetrical with respect to the center of the round shank. The rotation-restriction portions 48 are formed at positions apart by 45 degrees in a circumferential direction from the troughs 47 with respect to the center of the round shank.

Figure 20:
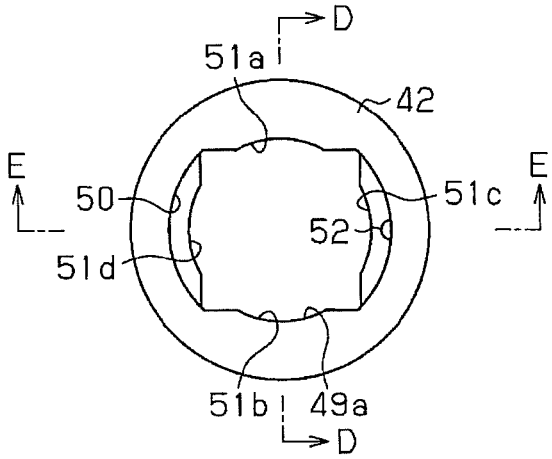
FIG. 20 is a front view showing a second coupling member of the second embodiment of the first aspect.
Figure 21:
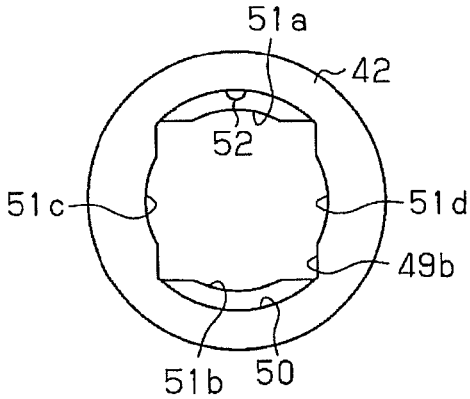
FIG. 21 is a rear view showing the second coupling member of the second embodiment of the first aspect.
Figure 22:
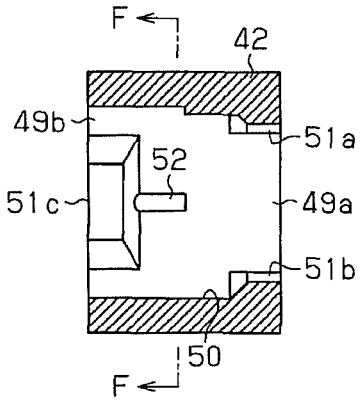
FIG. 22 is a sectional view taken along line D-D of FIG. 20.
Figure 23:
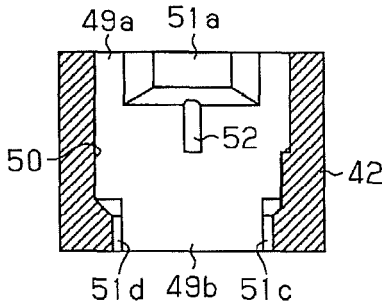
FIG. 23 is a sectional view taken along line E-E of FIG. 20.
Figure 24:
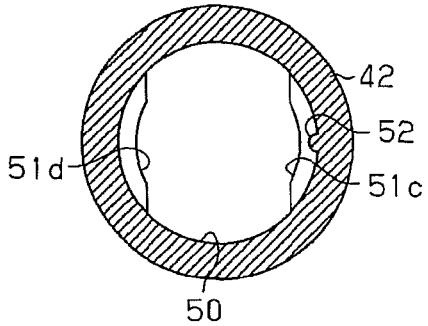
FIG. 24 is a sectional view taken along line F-F of FIG. 22.

The second coupling member 42 is molded into a tubular shape from the same synthetic resin as that of the first fitting part 43 and the balls 15, 44 and serves as a second fitting part having a fitting hole. As shown in FIGS. 20 and 21, opening portions 49*a*, 49*b* on both sides of the second coupling member 42 are formed into a bale shape into which the front end of the fitting protrusion 45, including the swelled portion 46, can be inserted. The opening portions 49*a*, 49*b* are so shaped that directions of the bale shapes are mutually rotated by 90 degrees with respect to the center of the tube.

A circular hole 50 having a diameter which allows the front end of the fitting protrusion 45 to rotate is formed inside the second coupling member 42. Formed at opening edges in the short-axis direction of the bale shape of the opening portion 49*a* are locking portions 51*a*, 51*b* for preventing the swelled portion 46 from coming out of the circular hole 50. Formed at opening edges in the short-axis direction of the bale shape of the opening portion 49*b* are locking portions 51*c*, 51*d* for preventing the swelled portion 46 from coming out of the circular hole 50.

Ridges 52 configured to engage with the troughs 47 are formed on the inner peripheral surface of the circular hole 50 inside the locking portions 51*a*, 51*c*.

Figure 25:
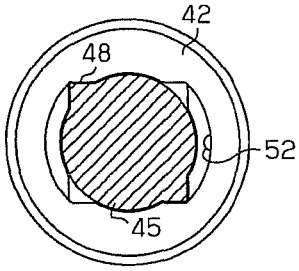
FIG. 25 is a sectional view showing the fit between the coupling members of the second embodiment of the first aspect.

To couple the first coupling member 41 and the second coupling member 42, the fitting protrusion 45 of the first fitting part 43 is inserted into the opening portion 49*a* of the second coupling member 42, and the first fitting part 43 is rotated clockwise relative to the second coupling member 42. Thus, the troughs 47 of the swelled portion 45 becomes engaged with the ridges 52 in the circular hole 50. As a result, the rotation-restriction portions 48 move from corners of the bale shape of the opening portion 49*a* to adjacent corners, achieving positioning as shown in FIG. 25.

Similarly, the first coupling member 41 is positioned by inserting it into the other opening portion 49*b* of the second coupling member 42 and rotating it by 90 degrees. As a result, as shown in FIG. 14, the first coupling members 41 are coupled together via the second coupling member 42.

In this state, the swelled portions 46 of the fitting protrusions 45 of the first coupling members are engaged with the locking portions 51*a* to 51*d* of the second coupling member 42, and are held within the circular hole 50 of the second coupling member 42.

The holding force for holding this engagement is set to a magnitude such that the fitting protrusion 45 does not come out of the second coupling member 42 by a normal pull force applied to the ball chain 9 in a usual slat up/down operation and a slat angle adjustment operation. Only when a great pull force that exceeds the normal pull force is applied to the ball chain 9, the opening portions 49*a*, 49*b* of the second coupling member 42 are enlarged due to the resiliency of the synthetic resin of the second coupling member 42 by the swelled portions 46 of the fitting protrusions 45. Thus, the fitting protrusions 45 are uncoupled from the second coupling member 42.

The external shape in a state where the first fitting parts 43 are fitted with both sides of the second coupling member 42 is so designed as to be the same as that of the ball 15.

The hemispheroids 20 of the first coupling members 41 are welded and fixed to the hemispheroids 15*a* formed on both ends of the main cord 14, forming balls having the same shape as the ball 15. By coupling the first coupling members 41 via the second coupling member 42, the endless ball chain 9 is formed.

In the ball chain 9 thus configured, balls having the same shape are formed at regular intervals along the total length of the main cord 14 of the ball chain 9 and the coupling cord 19 of the coupling portion 16. Therefore, the ball chain 9 can be rotated around the pulley 8 unlimitedly.

The ball chain thus configured can show the following effects.

(1) Balls having the same shape are formed at regular intervals along the total length of the main cord 14 of the ball chain 9 and the coupling cord 19 of the coupling portion 16. Therefore, it is possible to rotate the ball chain 9 around the pulley 8 unlimitedly so as to perform a slat up/down operation.

(2) By releasing the fit between the first fitting part 43 and the second coupling member 42 and thus unlooping the ball chain 9 during non-use of the blind, the dweller can be prevented from tripping over the ball chain 9 and thus causing an accident.

(3) By unlooping the ball chain 9 to replace it, the ball chain 9 can be detached without having to cut it.

(4) By engaging the non-looped ball chain 9 with the pulley, the ball chain 9 can be mounted without having to detach the pulley cover or pulley.

(5) By fitting the first coupling members 41 into the second coupling member 42 again after the fit in the coupling portion 16 is released, the endless ball chain 9 can be reconstructed easily.

(6) A configuration is adopted where the fitting protrusions 45 are fitted into the second coupling member 42 by inserting fitting protrusions 45 into the opening portions 49*a*, 49*b* of the second coupling member 42 and then rotating them by 90 degrees. As a result, it is possible to obtain a sufficient holding force to hold the fitting protrusions 45 within the second coupling member 42 while minimizing the operation force for fitting the fitting protrusions 45 into the second coupling member 42.

(7) The first coupling members 41 coupled via the second coupling member 42 are held at angles such that center lines of the fitting protrusions 45 intersect each other at a right angle. Therefore, when a pull force is applied to the fitting protrusion 45, the swelled portions 46 of the fitting protrusion 45 work on the opening portions 49*a*, 49*b* of the second coupling member 42 in directions which are different from each other by 90 degrees, that is, the swelled portions 46 work on the second coupling member 42 so as to expand the second coupling member 42 in four directions from the center thereof. Thus, the holding force can be easily ensured.

(8) Since the operation force for fitting the fitting protrusions 45 into the cylindrical second coupling member 42 is minimized, the fitting protrusions 45 can be fitted into the second coupling member 42 again without using a tool. Therefore, even when the coupling portion 16 is uncoupled, the dweller can easily restore the fit.

The above embodiment may be carried out in the following mode.

Figure 26:
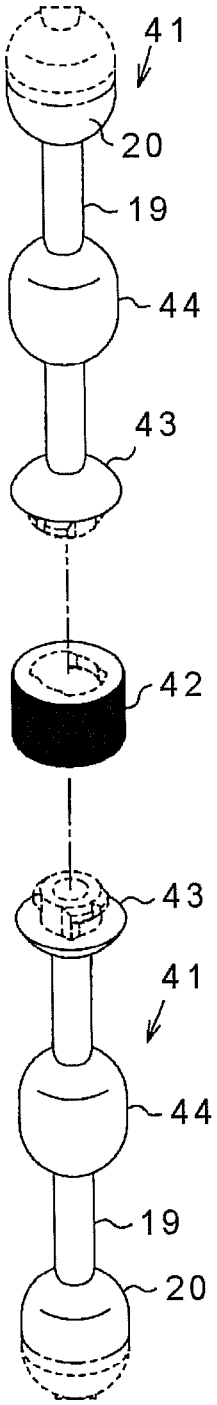
FIG. 26 is a perspective view showing a modification of the coupling portion of the second embodiment of the first aspect.

- The first fitting parts 43 and the second coupling member 42 may be formed of a material having rigidity larger than a synthetic resin. In this case, the fail-safe function is not obtained. However, even when a great force is applied to the ball chain 9, the ball chain 9 is not unlooped. As a result, the ball chain 9 can be avoided from being unexpectedly unlooped.
- As shown in FIG. 26, the color of the second coupling member 42 may differ from that of the main cord 14 or ball 15. This makes it easy to find the coupling portion 16. Alternatively, the color of the first fitting parts 43 may differ from that of the main cord 14 or ball 15, or both colors of the first fitting parts 43 and the second coupling member 42 may differ from that of the main cord 14 or ball 15. Alternatively, the colors of the first fitting parts 43 forming a pair may differ from each other. In this case, by associating the difference between the colors with the difference between the operation directions of the ball chain 9, a blind pull-up direction or blind pull-down direction can be indicated.
- The first fitting parts 43 may directly be outsert-molded at both ends of the main cord 14.
- A similar shape may be formed using methods other than outsert molding.
- The coupling portion 16 may be used as the coupling portion of an endless operation cord for a sunlight shielding apparatus.
- The coupling portion 16 having a fail-safe function may be provided on the intermediate portion of a hoisting cord or operation cord which is suspended from the head box of a horizontal blind and coupled to the bottom rail.
- In each embodiment, the areas of the respective contact surfaces between the hemispheroids 15*a* and the hemispheroids 20, 24 may be increased by inclining the contact surfaces with respect to the respective axes of the hemispheroids 15*a* and the hemispheroids 20, 24.
- The balls 44 may be omitted, or two or more balls 44 may be provided.

Third Embodiment of First Aspect

Hereafter, a third embodiment of the first aspect of the present invention will be described with reference to FIGS. 27 to 35.

This embodiment is similar to the second embodiment but differs therefrom in the configuration of the coupling portion 16. In this embodiment, an "operation cord" of the claims is a ball chain 9; a "first coupling part" and a "second coupling part" is each composed of a first coupling member 17 including a hemispheroid 20; and the "first coupling part" and the "second coupling part" can be coupled together via a second coupling member 18. The first coupling members 17 forming a pair are fixed to the main cord 14 by fixing the hemispheroids 20 to the hemispheroids 15*a* at both ends of the main cord 14.

Hereafter, this embodiment will be described in more detail.

Figure 27:
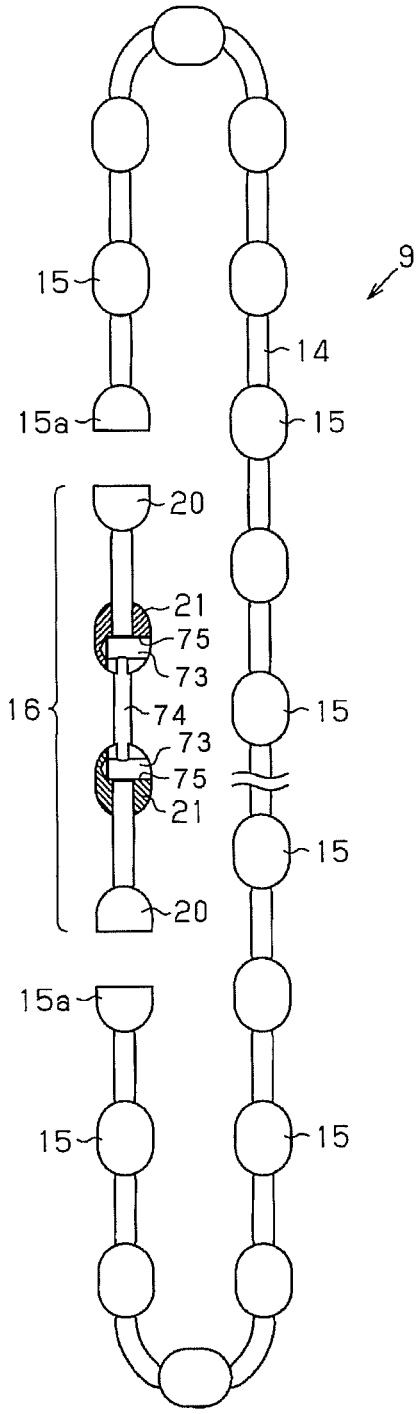
FIG. 27 is a front view showing a ball chain of a third embodiment of the first aspect.

As shown in FIG. 27, in the ball chain 9, balls 15 of a synthetic resin are molded at regular intervals on the main cord 14 of polyester. The balls 15 are prolate spheroidal solid bodies molded on a surface of the main cord 14 by a molding machine and are firmly fixed to the main cord 14 so as to be immovable.

Figure 28:
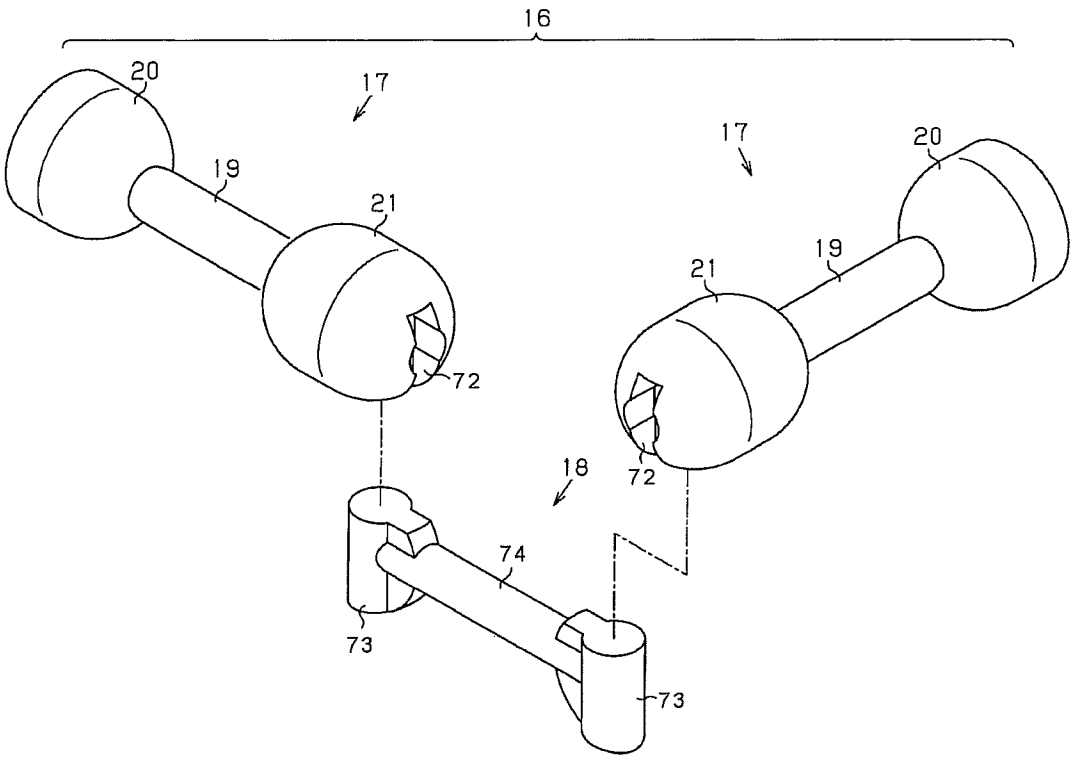
FIG. 28 is an exploded perspective view showing a coupling portion of the third embodiment of the first aspect.

Both ends of the main cord 14 are coupled together via the coupling portion 16 to form the endless ball chain 9. As shown in FIGS. 28 and 15, the coupling portion 16 is configured such that the two first coupling members 17 of the same structure are coupled together via the second coupling member 18.

In the first coupling member 17, the hemispheroid 20 having a shape of half the ball 15 is outsert-molded at an end of the coupling cord 19 made of the same material as that of the main cord 14, and the first fitting part 21 is formed at the other end. The interval between the first fitting part 21 and the hemispheroid 20 is the same as the interval between the balls 15.

The first fitting part 21 is formed by forming a fitting recess 72 on a ball having the same shape as the ball 15. The second coupling member 18 is configured such that a fitting protrusion 73 that can be fitted into the fitting recess 72 are provided at both ends of a shaft 74.

Figure 29:
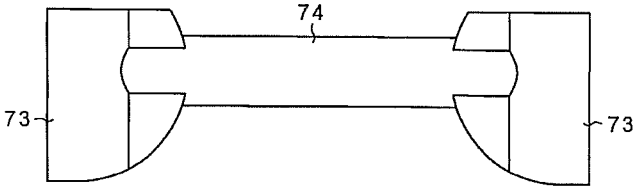
FIG. 29 is a front view showing a second coupling member of the third embodiment of the first aspect.
Figure 30:
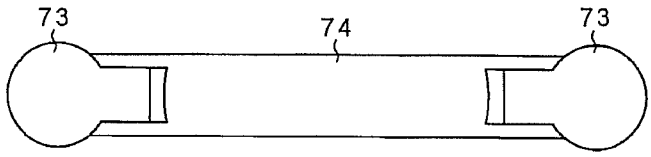
FIG. 30 is a side view showing a second coupling member of the third embodiment of the first aspect.
Figure 31:
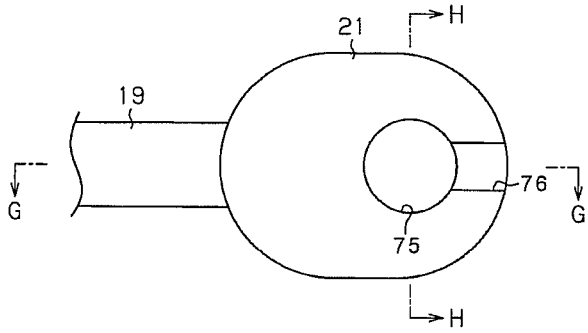
FIG. 31 is a front view showing a first coupling member of the third embodiment of the first aspect.
Figure 32:
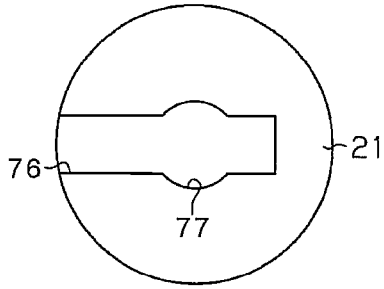
FIG. 32 is a side view showing a first coupling member of the third embodiment of the first aspect.
Figure 33:
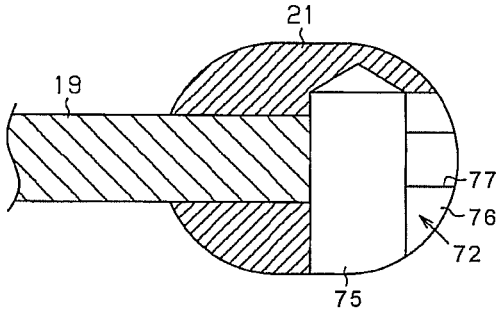
FIG. 33 is a sectional view taken along line G-G of FIG. 31.
Figure 34:
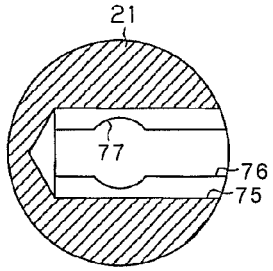
FIG. 34 is a sectional view taken along line H-H of FIG. 31.
Figure 35:
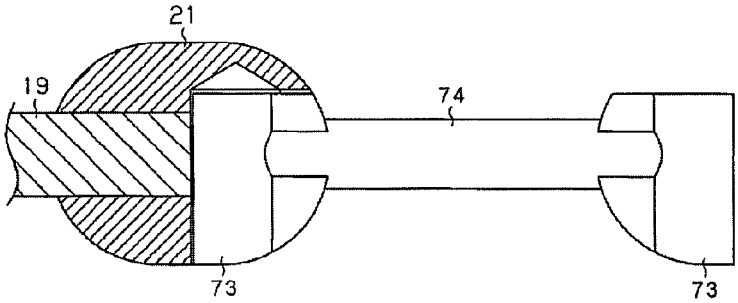
FIG. 35 is a sectional view showing the fitting state between the coupling members of the third embodiment of the first aspect.

The second coupling member 18 is molded integrally from a synthetic resin. As shown in FIGS. 29 and 30, the fitting protrusions 73 are formed at both ends of the shaft 74 so as to be line-symmetrical and in such a manner that the central axes of the round shafts thereof and the central axis of the shaft 74 are perpendicular to each other.

As shown in FIGS. 31 to 34, in the fitting recess 72, a fitting hole 75 is formed in a direction perpendicular to the central axis of the coupling cord 19. The fitting hole 75 is also formed with a diameter such that the fitting protrusion 73 can be easily inserted into the fitting hole 75.

The fitting hole 75 has an opening portion at an open groove 76 having a width smaller than the diameter of the fitting hole 75 toward the side opposite to the coupling cord 19. Formed on the open groove 76 is an insertion hole 77 into which the shaft 74 of the second coupling member 18 can be inserted.

As shown in FIG. 28, in the first coupling member 17 and the second coupling member 18 thus configured, when the fitting protrusions 73 of the second coupling member 18 are inserted into the fitting holes 75 of the first coupling members 17 in a direction perpendicular to the coupling cord 19, the first coupling members 17 are coupled together via the first coupling member 17.

In this state, the round axial fitting protrusion 73 is held in the fitting hole 75. The force for this engagement is set to a magnitude such that the fitting protrusion 73 is not uncoupled from the fitting hole 75 by a normal pull force applied to the ball chain 9 in a usual slat up/down operation and slat angle adjustment operation. Only when a great pull force that exceeds the normal pull force is applied to the ball chain 9, the open groove 76 is enlarged at the fitting protrusion 73 due to the resiliency of the synthetic resin of the first coupling member 17. Thus, the fitting protrusion 73 is uncoupled from the fitting hole 75.

Further, the fitting protrusion 73 and the first fitting part 21 are formed so that the external shape in a state where the fitting protrusion 73 is fitted into the first fitting part 21 is approximately the same as that of the ball 15.

The hemispheroids 20 of the first coupling members 17 are welded and fixed to the hemispheroids 15*a* which are outsert-molded on both ends of the main cord 14, forming balls having substantially the same shape as that of the ball 15. By coupling the first coupling members 17 via the second coupling member 18, the endless ball chain 9 is formed.

The ball chain according to this embodiment can show the following effects.

(1) Balls having the same shape are formed at regular intervals along the total length of the main cord 14 of the ball chain 9 and the coupling cords 19 and the shaft 24 of the coupling portion 16. Therefore, it is possible to rotate the ball chain 9 around the pulley 8 unlimitedly so as to perform slat up/down operation.

(2) By releasing the fit between the fitting protrusion 73 and the fitting hole 75 to unloop the ball chain 9 during nonuse of the blinding, the dweller can be prevented from tripping over the ball chain 9 and thus causing an accident.

(3) By unlooping the ball chain 9 to replace it, the ball chain 9 can be detached without having to cut it.

(4) By engaging the unlooped ball chain 9 with the pulley, the ball chain 9 can be mounted without having to detach the pulley cover or pulley.

(5) When a great pull force exceeding a normal pull force is applied to the ball chain 9, the fit between the fitting protrusion 73 and the fitting hole 75 of the coupling portion 16 is released. Accordingly, it is possible to provide a fail-safe function of, when the endless edge of the ball chain 9 is caught on a dweller or another mobile object moving in the room, cutting the ball chain 9 to ensure the safety of the dweller and prevent damage to such as the pulley with which the ball chain is engaged.

(6) By fitting the fitting protrusion 73 into the fitting hole 75 again after the fit between the fitting protrusion 73 and the fitting hole 75 of the coupling portion 16 is released, the endless ball chain 9 can be reconstructed easily.

(7) A configuration is adopted where the fitting protrusion 73 is inserted and fitted into the fitting recess 72 of the first coupling member 17 in a direction perpendicular to the extending direction of the coupling cord 19. As a result, it is possible to fit the fitting protrusion 73 into the first coupling member 17 by a slight operation force, as well as to obtain a sufficient force to hold the fitting protrusion 73 in the first coupling member 17.

(8) When fitting the fitting protrusion 73 into the fitting hole 75, no tool or the like is required. This makes it possible to easily perform an operation of assembling the ball chain 9 and an operation of fitting the fitting protrusion 73 into the fitting hole 75 again.

The above embodiment may be carried out in the following mode.

The first fitting part 21 and the second coupling member 18 may be formed of a material having rigidity larger than that of a synthetic resin. In this case, the fail-safe function is not obtained. However, even when a great force is applied to the ball chain 9, the ball chain 9 is not unlooped. As a result, the ball chain 9 can be avoided from being unexpectedly unlooped.

The color of the second coupling member 18 may differ from that of the main cord 14 or ball 15. This makes it easy to find the coupling portion 16. Alternatively, the color of the first fitting part 21 may differ from that of the main cord 14 or ball 15, or both colors of the first fitting part 21 and the second coupling member 18 may differ from that of the main cord 14 or ball 15. Alternatively, the colors of the first fitting parts 21 forming a pair may differ from each other. In this case, by associating the difference between the colors with the difference between the operation directions of the ball chain 9, the pull-up or pull-down direction of the blind can be indicated.

The first fitting parts 21 may be directly outsert-molded at both ends of the main cord 14.

A similar shape may be formed using methods other than outsert molding.

The second coupling member 18 may be formed by molding the fitting protrusions 23 at both ends of a cord formed of the material as that of the main cord 14.

The second coupling member 18 may be formed by molding the fitting protrusion 73 and the shaft 74 integrally from synthetic resins having different rigidities. In this case, a hard synthetic resin is used for the fitting protrusion 73, and a soft synthetic resin is used for the shaft 74.

A shaft having a polygonal section may be used as the fitting protrusion 73 in place of a round shaft.

The area of the contact surface between the hemispheroid 15*a* and the hemispheroid 20 may be increased by inclining the contact surface with respect to the respective axes of the hemispheroid 15*a* and the hemispheroid 20.

The coupling portion 16 having a fail-safe function may be provided on the intermediate portion of a hoisting cord or operation cord which is suspended from the head box of a horizontal blind and coupled to the bottom rail. In this case, the coupling cord 19 of the first coupling member 17 is sewn on an end of the up-down cord or operation cord, and the first coupling members 17 are coupled together via the second coupling member 18.

Fourth Embodiment of First Aspect

Figure 36:
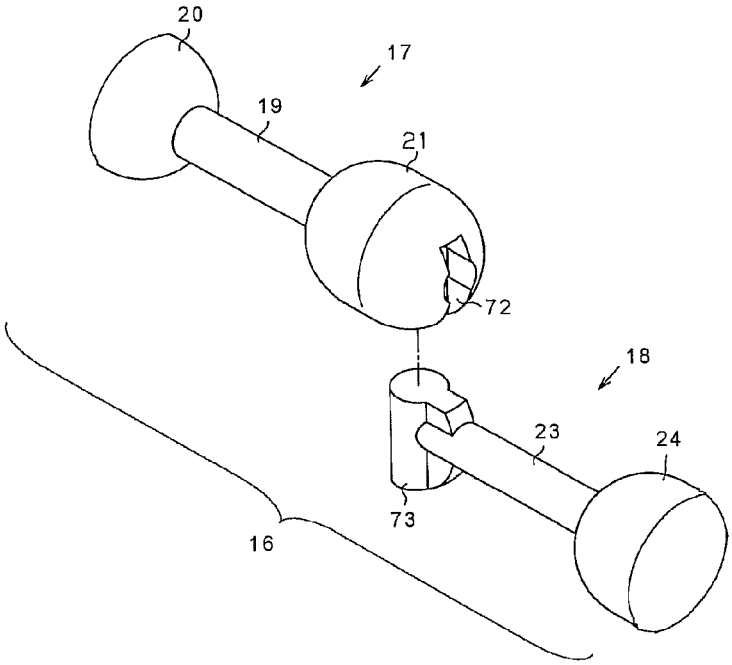
FIG. 36 is an exploded perspective view showing a coupling portion of a fourth embodiment of the first aspect.
Figure 37:
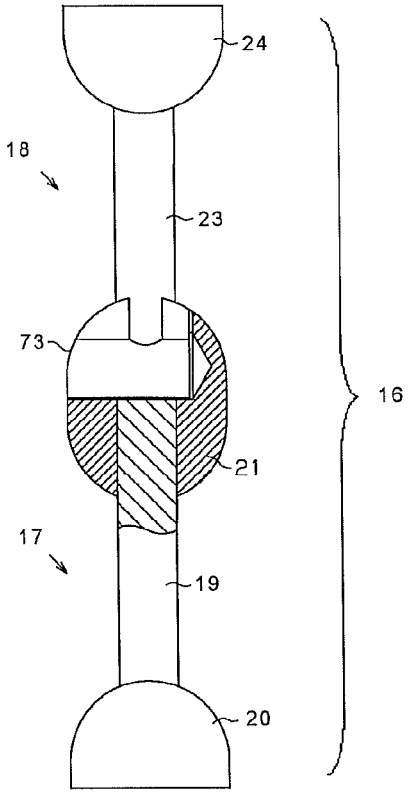
FIG. 37 is a sectional view showing the fit between the coupling members of the fourth embodiment of the first aspect.

Hereafter, a fourth embodiment of the first aspect of the present invention will be described with reference to FIGS. 36 and 37.

The coupling portion 16 of the ball chain 9 according to this embodiment is similar to that of the third embodiment in terms of the fitting structure between the first coupling member 17 and the second coupling member 18. Note that the coupling portion 16 of this embodiment is composed of two pieces: the first coupling member 17 having the fitting recess 72 and the second coupling member 18 having the fitting protrusion 73 which is to be fitted into the fitting recess 72.

The first fitting part 21 and the fitting protrusion 73 may directly be outsert-molded at both ends of the main cord 14. Other effects and modifications are basically the same as those of the third embodiment.

Fifth Embodiment of First Aspect

Hereafter, a fifth embodiment of the first aspect of the present invention will be described with reference to FIGS. 38 and 39.

This embodiment is the same as the first embodiment in terms of the fitting structure of the coupling portion 16. On the other hand, this embodiment differs from the first embodiment in that in the first embodiment, the "operation cord" is the ball chain 9; in this embodiment, it is not a ball chain but an operation cord 98 whose sectional area does not substantially change along the length direction (may change slightly, for example, the sectional area may slightly decrease near the coupling portion 16 as in FIG. 41), as shown in FIG. 38. In this embodiment, a "first coupling part" of the claims is composed of the first coupling member 27 including the coupling cord 19, and a "second coupling part" is composed of the second coupling member 28 including the coupling cord 23. The first coupling member 27 and the second coupling member 28 are fixed to the main cord 14 by inserting the coupling cords 19, 23 into the axes of both ends of the main cord 14 and sewing them.

Figure 38:
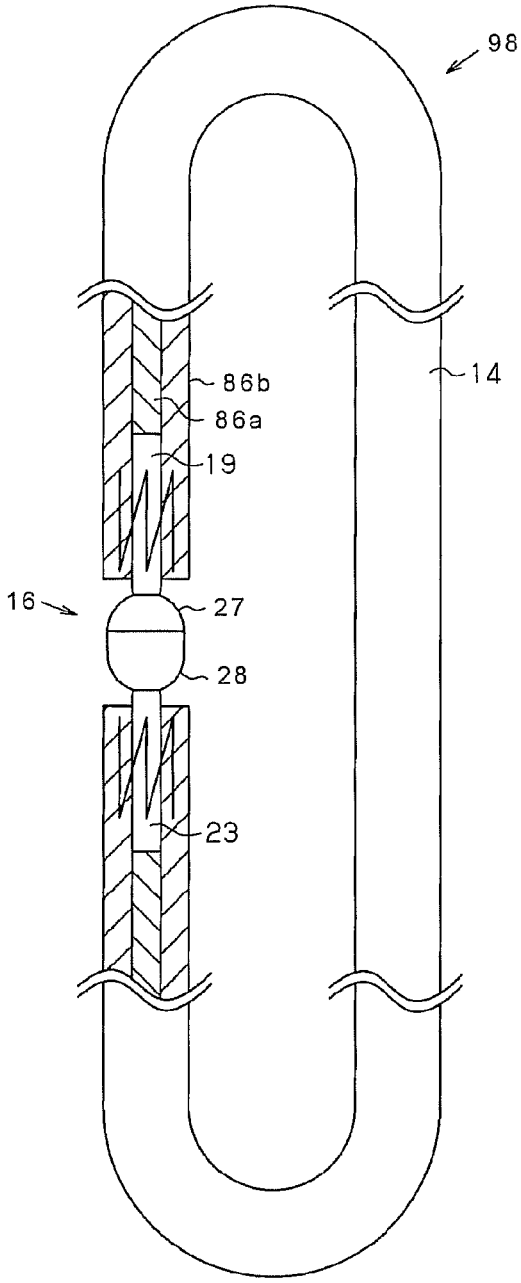
FIG. 38 is a front view showing an operation cord of a fifth embodiment of the first aspect.

As shown in FIG. 38, by coupling together both ends of the main cord 14 via the coupling portion 16, the endless operation cord 98 is formed. The main cord 14 is formed by covering a core 86*a* formed of polyester, nylon, or the like with a covering cord 86*b* woven from polyester. Use of the core 86*a* allows the operation cord 98 to ensure linearity, as well as allows durability in an extension direction to be obtained.

Figure 39:
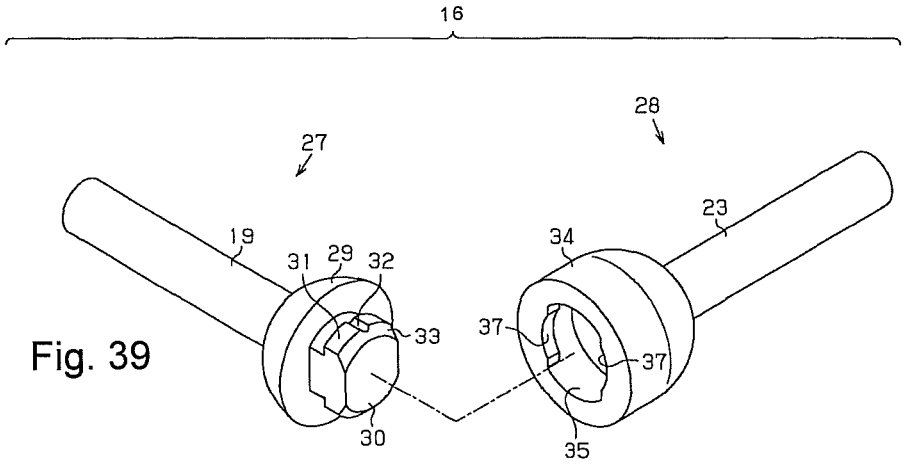
FIG. 39 is an exploded perspective view showing a coupling portion of the fifth embodiment of the first aspect.

As shown in FIG. 39, the coupling portion 16 is composed of the first coupling member 27 and the second coupling member 28. In the first coupling member 27, the first fitting part 29 is formed of a synthetic resin at one end of the coupling cord 19 formed of the same material as that of the core 86*a* of the main cord 14. Formed at the front end of the first fitting part 29 is the fitting protrusion 30 having a bale-shaped cross-section obtained by cutting off both sides of a round shank in parallel.

In the second coupling member 28, the second fitting part 34 formed of the same material as that of the first fitting part 29 is molded at one end of the coupling cord 23 similar to the coupling cord 19. The base end of the second fitting part 34 is formed into a hemispheroid, and the fitting hole 35 is formed at the front end thereof. As shown in FIG. 38, to attach the first coupling member 27 and the second coupling member 28 to the main cord 14, the core 86*a* at both ends of the main cord 14 is eliminated to form space in the axis, and the coupling cords 19, 23 of the first coupling members 27 and the second coupling member 28 are inserted into the space. By sewing the outer covering cord 86*b* and the coupling cords 19, 23 in this state, the first coupling member 17 and the second coupling member 18 are attached to the main cord 14.

The above embodiment may be carried out in the following mode.

- The first fitting part 29 and the second fitting part 34 may directly be outsert-molded at both ends of the main cord 14.
- A similar shape may be formed using methods other than outsert molding.
- The first coupling member 27 and the second coupling member 28 may be fixed to the main cord 14 using methods other than the method of inserting the coupling cords 19, 23 into the axis of both ends of the main cord 14 and sewing them.

Sixth Embodiment of First Aspect

Figure 40:
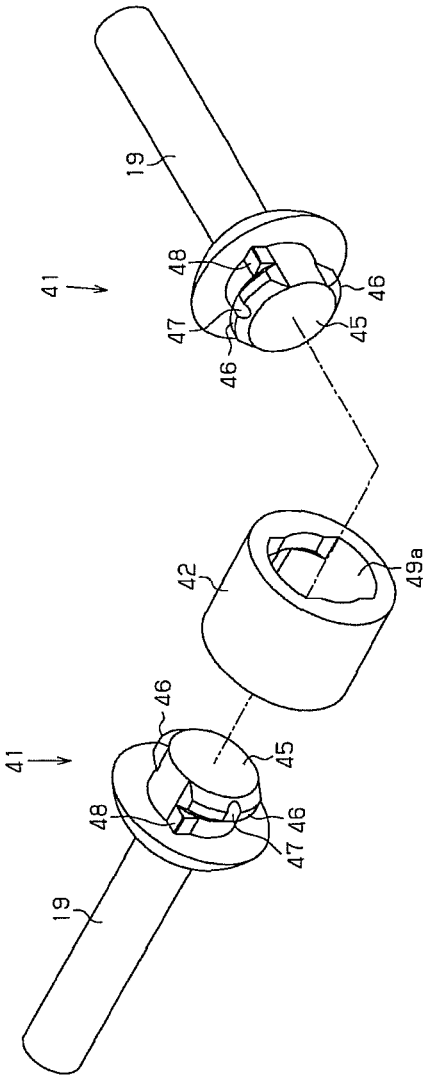
FIG. 40 is an exploded perspective view showing a coupling portion of a sixth second embodiment of the first aspect.

Hereafter, a sixth embodiment of the first aspect of the present invention will be described with reference to FIG. 40.

This embodiment is similar to the fifth embodiment but differs therefrom in the configuration of the coupling portion 16. In this embodiment, an "operation cord" of the claims is the operation cord 98; a "first coupling part" and a "second coupling part" is each composed of the first coupling member 41 including the coupling cord 19; and the "first coupling part" and the "second coupling part" can be coupled together via the second coupling member 42. The first coupling members 41 forming a pair are fixed to the main cord 14 by inserting the coupling cords 19 into the axes of both ends of the main cord 14 and sewing them. The fitting structure of the coupling portion 16 of this embodiment is the same as that of the third embodiment. A method for fixing the first coupling members 41 to the main cord 14 is the same as that of the fifth embodiment.

The operation cord according to this embodiment can exhibit similar effects to those of the fifth embodiment; the coupling portion 16 according to this embodiment can show effects similar to those of the second embodiment.

Seventh Embodiment of First Aspect

Hereafter, a seventh embodiment of the first aspect of the present invention will be described with reference to FIGS. 41 to 43.

This embodiment is the same as the sixth embodiment in the fitting structure of the coupling portion 16 but differs therefrom in the configuration of the operation cord 98 and the method for fixing the first coupling member 41 to the main cord 14. In this embodiment, a "first coupling part" and a "second coupling part" of the claims is composed of a pair of first coupling members 41 including a locking portion 99 configured to engage with a flange 81 of the main cord 14, and the "first coupling part" and the "second coupling part" can be coupled together via the second coupling member 42. The first coupling members 41 forming a pair can be fixed by outsert molding them at both ends of the main cord 14 at which the flanges 81 are formed.

Figure 41:
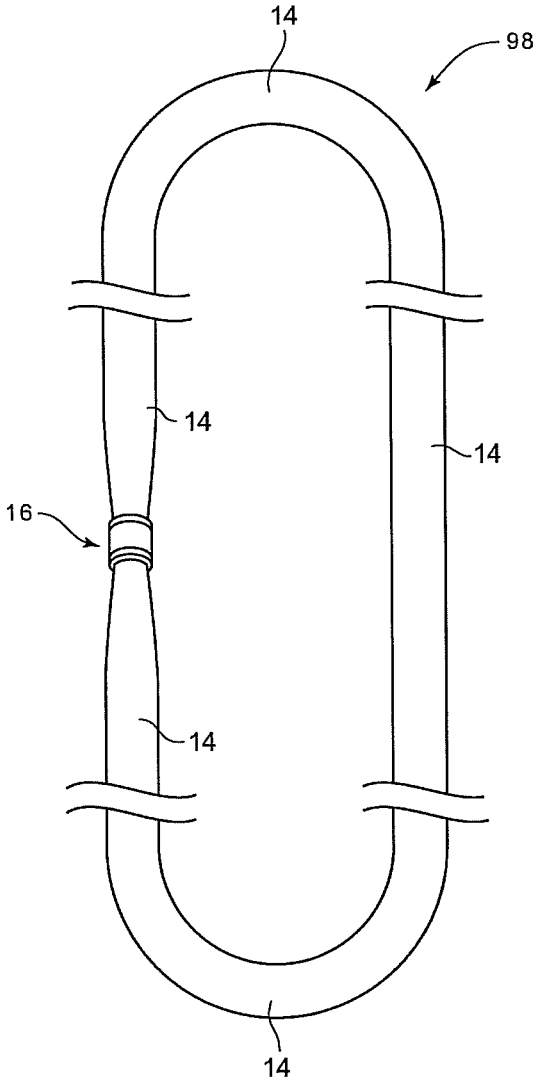
FIG. 41 is a front view showing an operation cord of a seventh embodiment of the first aspect.

FIG. 41 is a front view illustrating the operation cord 98 according to this embodiment. FIG. 42 is a sectional view illustrating the coupling portion 16 included in the operation cord 98 according to this embodiment. FIG. 43 is an exploded perspective view illustrating the coupling portion 16 included in the operation cord 98 according to this embodiment.

As shown in FIG. 41, by coupling both ends of the main cord 14 together via the coupling portion 16, the endless operation cord 98 is formed. The main cord 14 is cylindrical, and both ends thereof are tapered down. The main cord 14 is preferably formed of, e.g., a polyester resin. The main cord 14 is not limited to a particular material, as long as the material is a thermoplastic resin having a predetermined or higher level of strength, and may be formed of a resin other than a polyester resin, or a polyamide resin. The core formed of a polyester resin, polyamide resin, or the like may be covered with a covering cord woven from a polyester resin. Use of the core thus configured allows the operation cord 98 to ensure linearity, as well as durability in an expansion direction to be obtained.

Figure 42:
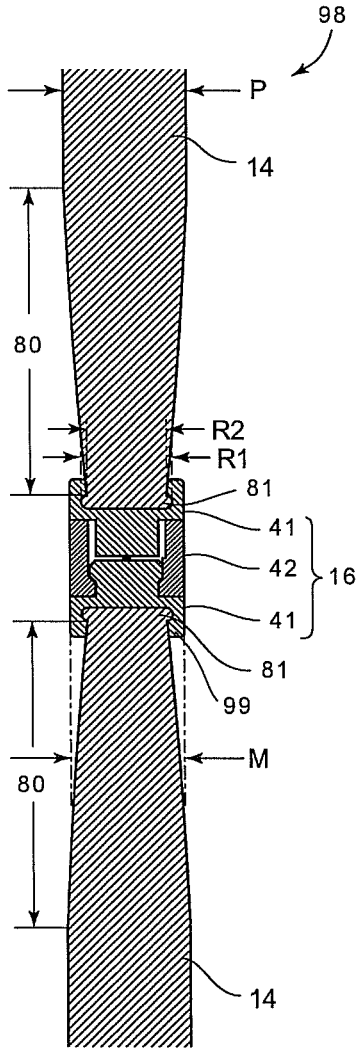
FIG. 42 is a sectional view showing a coupling portion of the seventh second embodiment of the first aspect.
Figure 43:
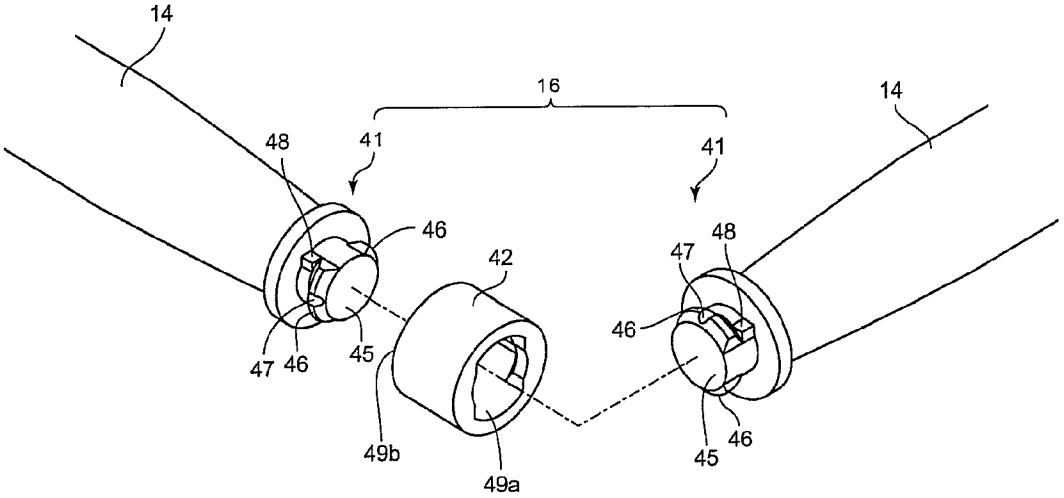
FIG. 43 is an exploded perspective view showing a coupling portion of the seventh embodiment of the first aspect.

As shown in FIGS. 42 and 43, the coupling portion 16 is configured such that the pair of first coupling members 41 are coupled together via the second coupling member 42 provided therebetween. The coupling portion 16, which includes the three members, is cylindrical and formed so that the outer diameter thereof, that is, an outer diameter M in a transverse direction is smaller than a maximum diameter P of the main cord 14. Note that the coupling portion 16 may be formed such that the outer diameter M is the same as the maximum diameter P of the main cord 14. The coupling portion 16 is formed as described above. Thus, there is almost no possibility that, when the operation cord 98 is operated to rotate the pulley in a forward or backward direction, the coupling portion 16 of the operation cord 98 formed in such a manner that the outer diameter M to a transverse direction is equal to or smaller than the maximum diameter P of the main cord 14 may come into contact with the inside of the pulley case. Further, the possibility that the coupling portion 16 may be caught in the recesses formed on the peripheral surface of the pulley is reduced. As a result, the operation cord 98 can be rotated smoothly. Further, the coupling portion 16 is formed with a longitudinal length which is 1.2 times or more and 2.5 times or less as long as the maximum diameter P of the main cord 14. For example, assuming that the maximum diameter P of the main cord 14 is 5.5 mm, the length of the coupling portion 16 may be 7 mm. Thus, it is possible to rotate the pulley smoothly while preventing the coupling portion 16 from coming into contact with the inside of the pulley case.

The flanges 81 for fitting with the first coupling member 41 are disposed at both tapered ends of the main cord 14 formed of a thermoplastic resin. In this embodiment, as shown in FIG. 42, each flange 81 is formed into a ring and such that the diameter thereof is larger than the smallest diameter at the tapered end and smaller than the maximum diameter P. The flanges 81 are intended to ensure sufficient strength of the contact between the main cord 14 and the first coupling member 41. As long as sufficient strength is ensured, the shape of the flanges 81 is not limited to a particular shape and may be in the shape of a cog or the like. The flanges 81 are also formed with an outer diameter R1 which is 1.05 to 1.3 times as large as a minimum diameter R2 of the main cord 14. This R1/R2 value is preferably 1.1 to 1.2 in terms of ease of formation of the flanges 81 and the strength of outsert molding with the first coupling member 41.

Various methods can be employed as a method for attaching the first coupling member 41 to both ends of the main cord 14. For example, first, heat is applied to both ends of the main cord 14 with both ends compressed, and the ring-shaped flanges 81 are formed at the front ends of the main cord 14 using a prepared mold. Subsequently, the first coupling members 41 each including a locking portion 99 are outsert-molded so as to cover the flanges 81. By performing such outsert molding, both ends of the main cord 14 are fixed to the first coupling members 41 with high contact strength. Note that the method for combing the first coupling members 41 with the main cord 14 is not limited to the above-mentioned method. For example, the first coupling members 41 including the locking portion 99 may be previously formed, followed by fitting of the flanges 81 formed at both ends of the main cord 14 into the first coupling members 41.

As shown in FIG. 42, shrunk portions 80 whose diameter gradually narrows toward the flange 81 are formed between the flanges 81 and the portions having the maximum diameter P of the main cord 14. This makes it easy to couple both ends of the main cord 14 to the first coupling members 41 included in the coupling portion 16, as well as to make the outer diameter M in the transverse direction of the coupling portion 16 equal to or smaller than the maximum diameter P of the main cord 14.

The fit structure of the coupling portion 16 of this embodiment is the same as that of the second embodiment. The coupling portion 16 shows similar effects to those of the second embodiment.

Figure 44:
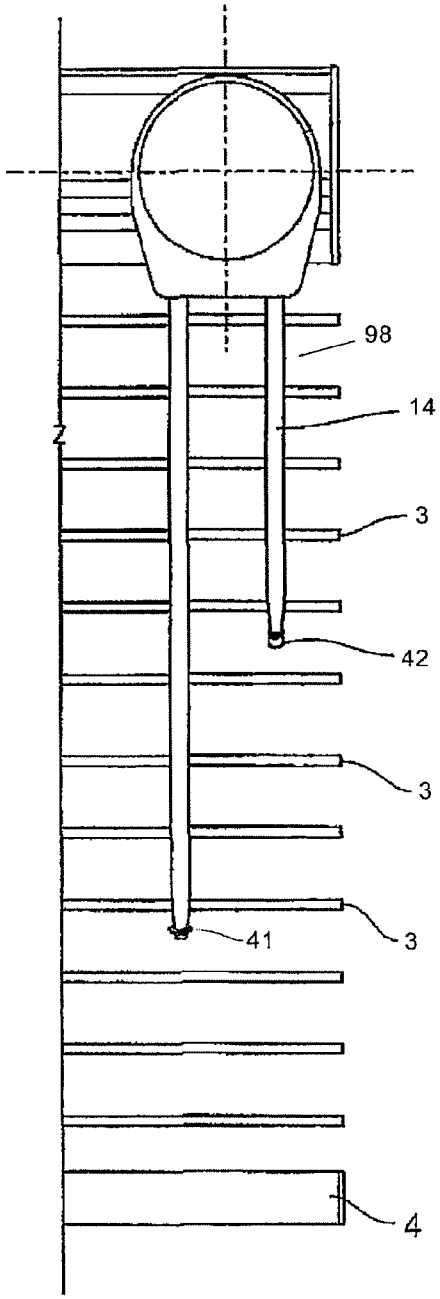
FIG. 44 is an exploded perspective view showing a coupling portion of an operation cord of an eighth embodiment of the first aspect.

During use of the blind, the first coupling member 41 and the second coupling member 42 are coupled together. Thus, the operation cord 98 is used in a looped state. During nonuse of the blind, as shown in FIG. 44, the operation cord 98 can be unlooped by releasing the fit between the first coupling member 41 and the second coupling member 42. Thus, the dweller can be prevented from tripping over the operation cord 98 and thus causing an accident. Further, the operation cord 98 can be easily attached or detached.

Eighth Embodiment of First Aspect

Figure 45:
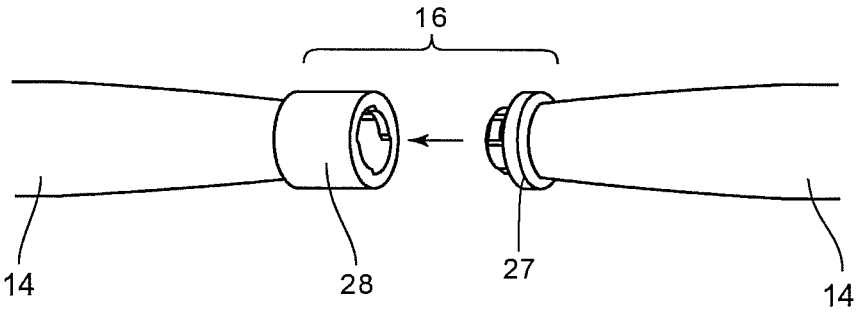
FIG. 45 is a sectional view showing a main part of the coupling portion shown in FIG. 44.
Figure 46:
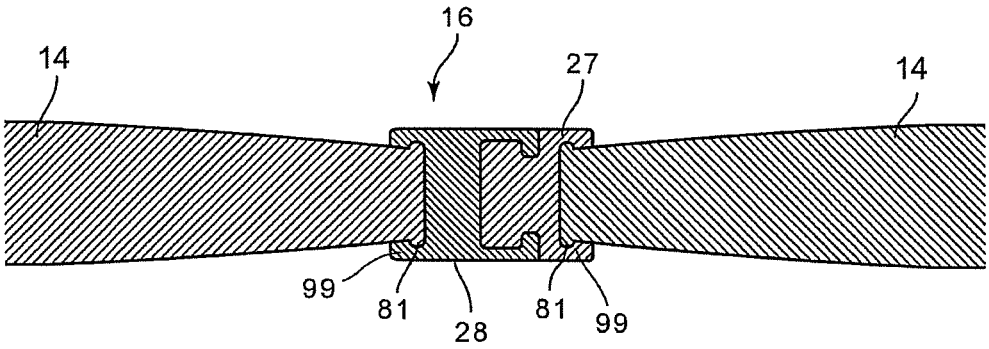
FIG. 46 is a front view showing a state where an operation cord of the seventh embodiment of the first aspect is unlooped.

Hereafter, an eighth embodiment of the first aspect of the present invention will be described with reference to FIGS. 45 and 46.

This embodiment is similar to the sixth embodiment but differs therefrom in the configuration of the coupling portion 16. In this embodiment, the "operation cord" of the claims is the operation cord 98; a "first coupling part" is the first coupling member 27 including the locking portion configured to engage with the flange 81 of the main cord 14; and a "second coupling part" is the second coupling member 28 including the locking portion configured to engage with the flange 81 of the main cord 14. The fitting structure of the coupling portion 16 is the same as that of the first embodiment. A method for fixing the first coupling member 27 and the second coupling member 28 to the main cord 14 is the same as that of the seventh embodiment.

In this embodiment, the operation cord can show similar effects to those of the seventh embodiment; the coupling portion 16 can show similar effects to those of the first embodiment.

Ninth Embodiment of First Aspect

Hereafter, a ninth embodiment of the first aspect of the present invention will be described with reference to FIGS. 47 to 51.

In this embodiment, an "operation cord" of the claims is a ball chain 9; a "main cord" is the main cord 14 having a ball 15*b* at both ends; a "first coupling part" and a "second coupling part" are each composed of a first coupling member 14 including a locking hole 82 which can engage with the ball 15*b* at the end of the main cord 14; and the "first coupling part" and the "second coupling part" can be coupled together via the second coupling member 42. The first coupling members 41 forming a pair are fixed to the main cord 14 by engaging the balls 15*b* at the ends of the main cord 14 with the locking holes 82.

Hereafter, this embodiment will be described in more detail.

Figure 47:
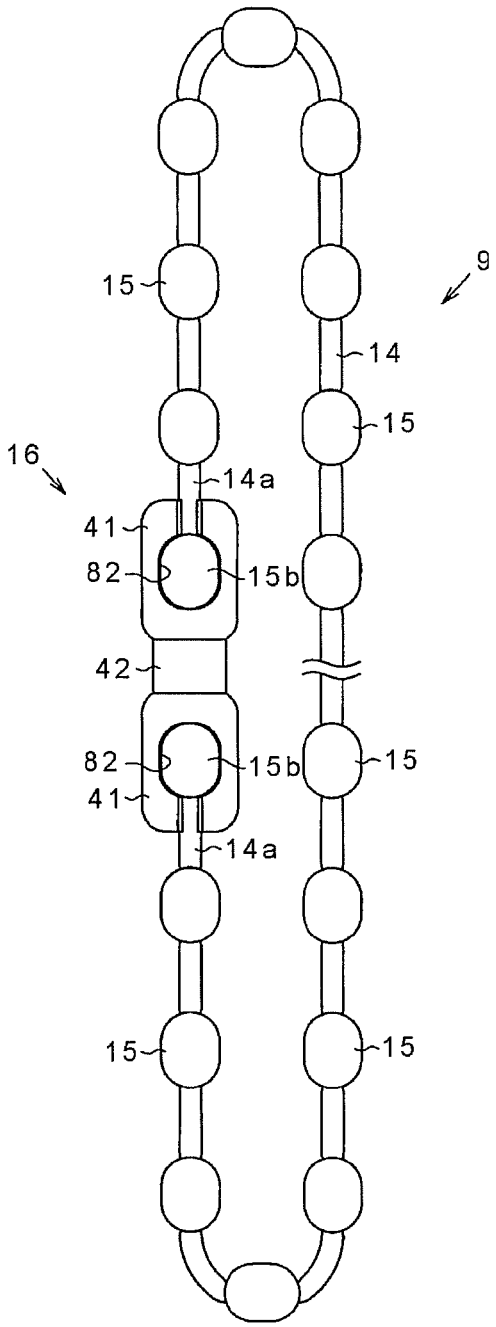
FIG. 47 is a front view showing a ball chain of a ninth embodiment of the first aspect.

In the ball chain 9 shown in FIG. 47, balls 15 of a synthetic resin are molded at regular intervals on the main cord 14 of polyester. The balls 15 are prolate spheroidal solid bodies molded on a surface of the main cord 14 by a molding machine and are firmly fixed to the cord 14 so as to be immovable.

Figure 48:
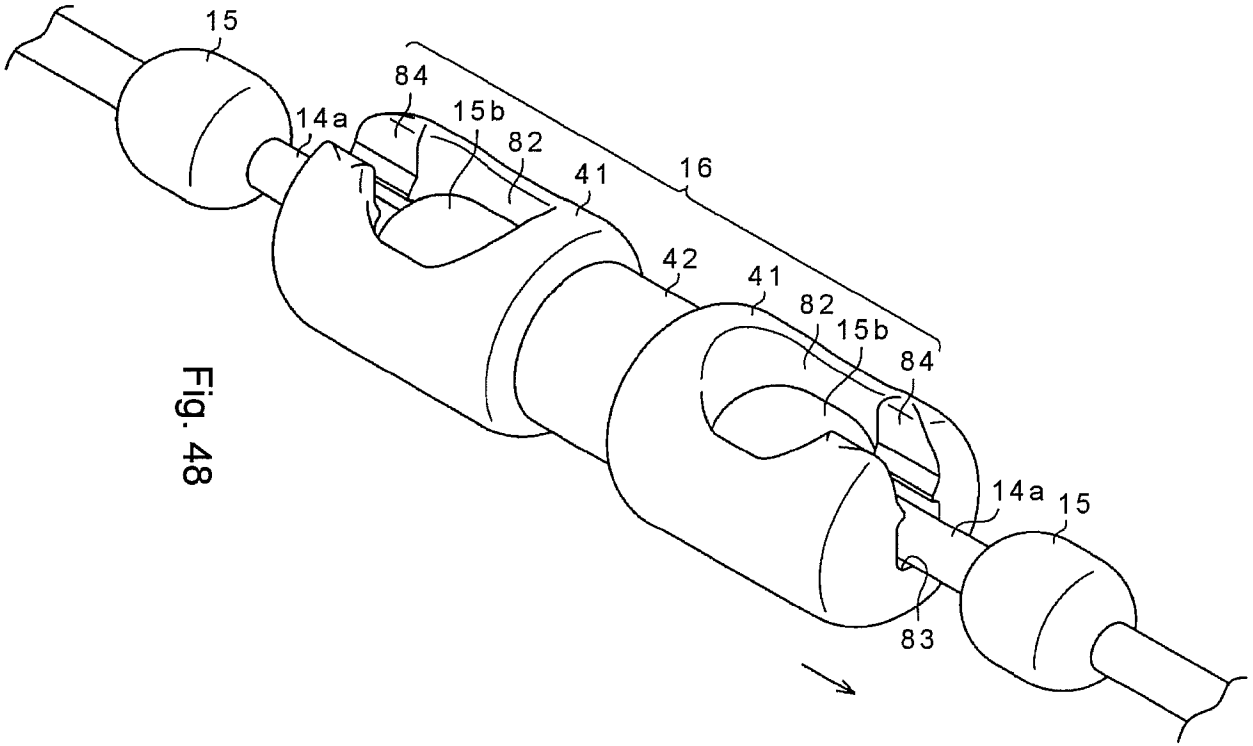
FIG. 48 is a perspective view showing a coupling portion of the ninth embodiment of the first aspect.
Figure 49:
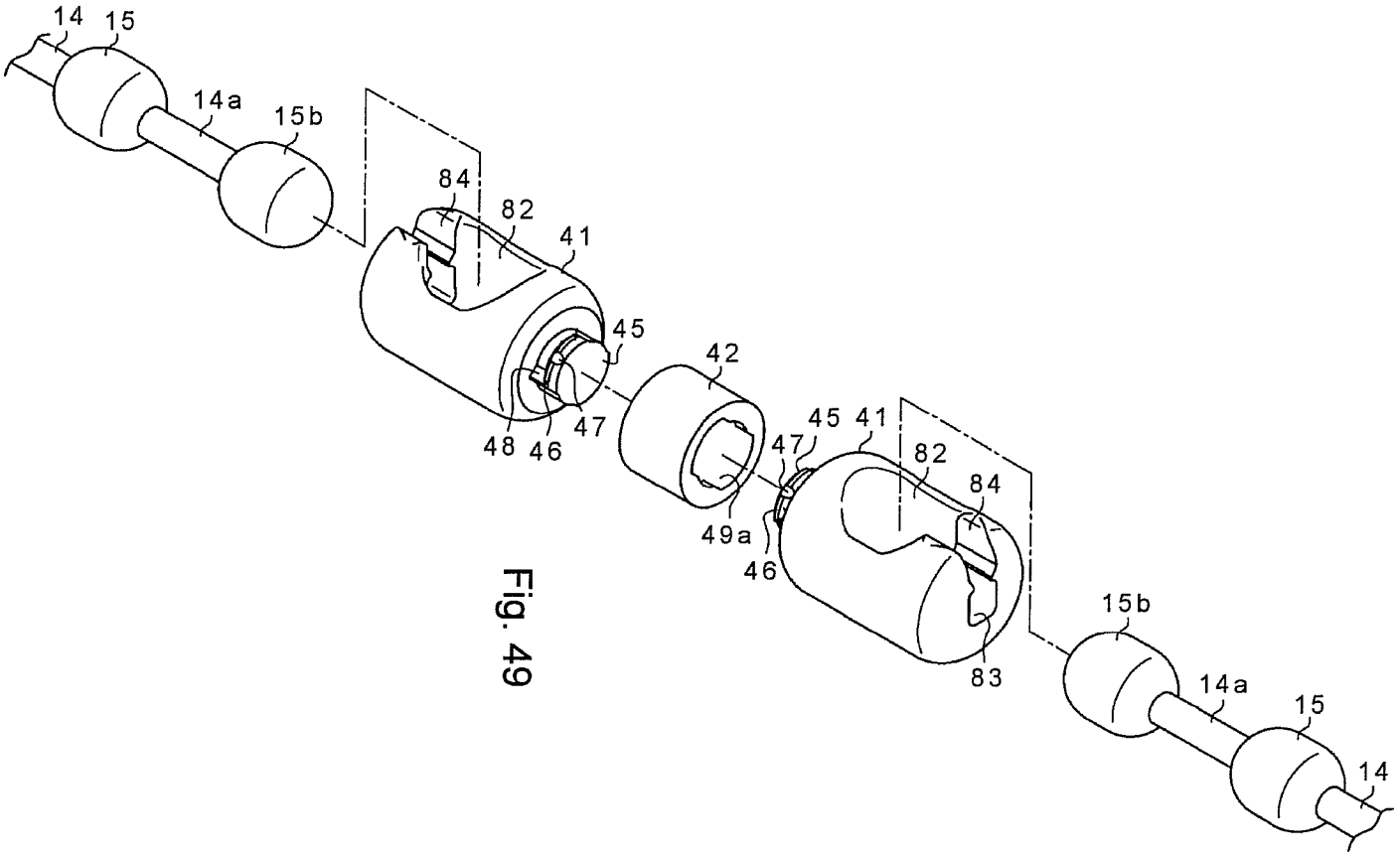
FIG. 49 is an exploded perspective view showing the coupling portion of the ninth embodiment of the first aspect.

By coupling both ends of the main cord 14 together via the coupling portion 16, the endless ball chain 9 is formed. As shown in FIGS. 48 and 49, the coupling portion 16 couples the balls 15*b* molded at both ends of the main cord 14 together using the two first coupling member 41 having the same configuration and the tubular second coupling member 42.

The coupling portion 16 couples the main cord 14 to form the endless ball chain 9. In a state where the ball chain 9 engages with the pulley, the coupling portion 16 serves as a stopper for setting the upper limit position of a pull-up operation of a roller screen or the like by abutting on the pulley and the pulley case. The first coupling members 41 are formed with external dimensions such that they cannot pass between the pulley and the pulley case.

Figure 50:
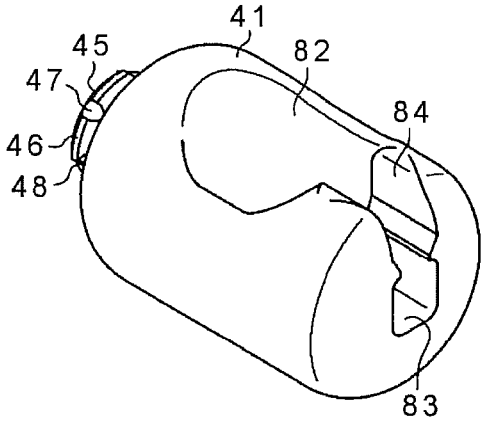
FIG. 50 is a perspective view showing the coupling portion of the ninth embodiment of the first aspect.
Figure 51:
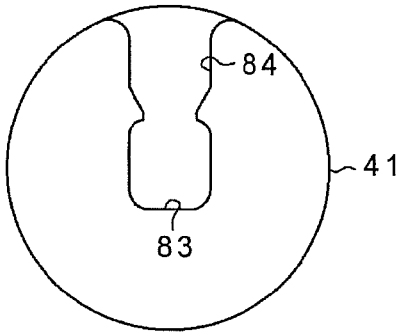
FIG. 51 is a side view showing the coupling portion of the ninth embodiment of the first aspect.

The specific configuration of the first coupling member 41 will be described with reference to FIGS. 50 and 51.

The first coupling member 41 is formed of a synthetic resin and in the form of approximately a rectangular parallelepiped. Disposed on the top surface thereof is the locking hole 82 having an oval opening into which the ball 15*b* can be inserted. As shown in FIG. 51, an insertion hole 83 communicating with the locking hole 82 has an opening portion at the center of the base end surface of the first coupling member 41. The insertion hole 83 also has an opening portion on the top surface of the first coupling member 41 via a guide groove 84.

By inserting the balls 15*b* formed at the ends of the main cord 14 into the locking holes 82 and inserting the main cord 14*a* communicating with the balls 15*b* into the insertion holes 83 via the guide grooves 84, the balls 15*b* are held in the locking holes 82 in such a manner that the balls 15*b* cannot be pulled out in an arrow direction shown in FIG. 48.

The fitting structure of the coupling portion 16 is the same as that in the second embodiment.

The ball chain 9 thus configured shows effects similar to those in the second embodiment.

Figure 52:
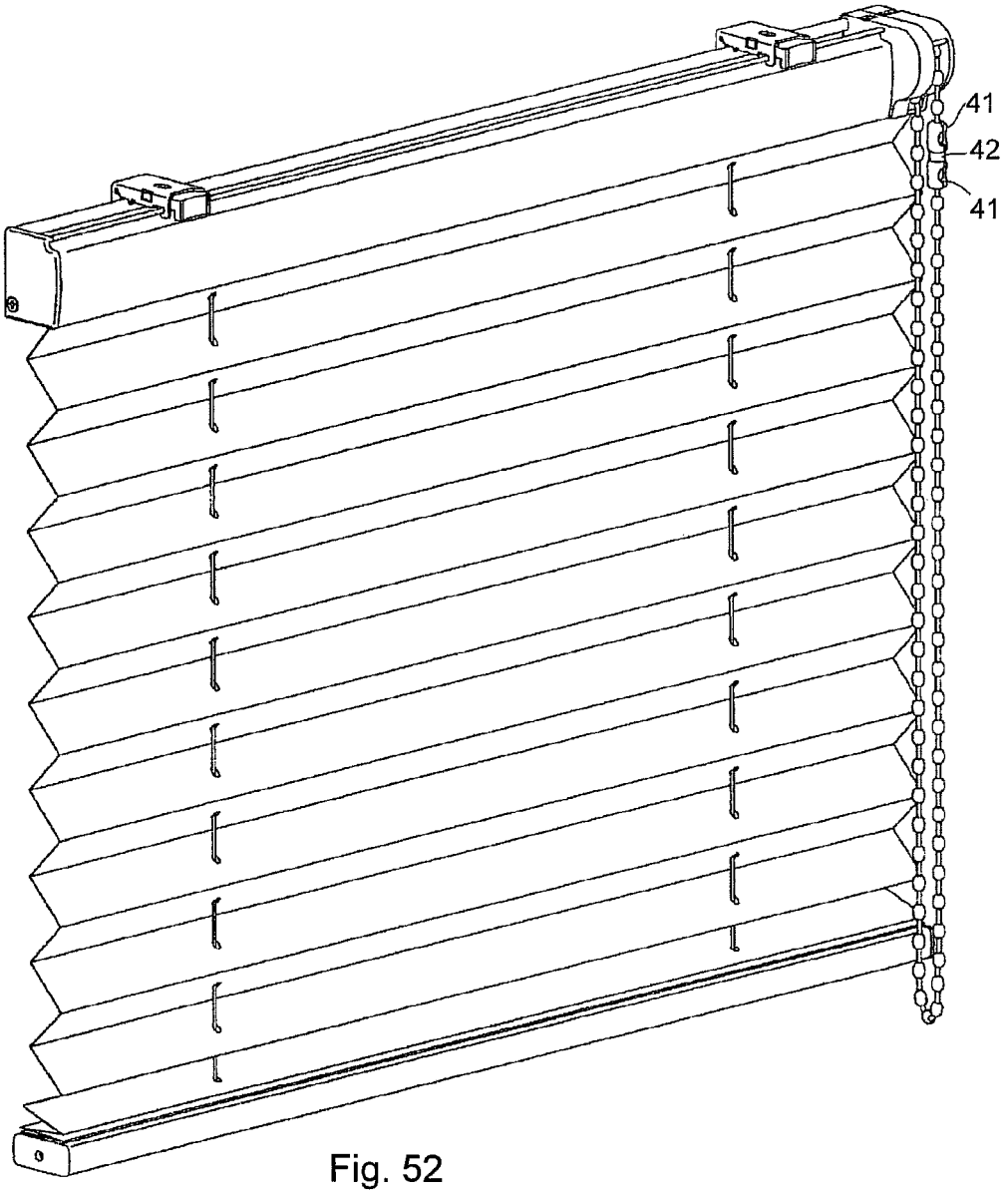
FIG. 52 is a perspective view showing a state where a ball chain of the ninth embodiment of the first aspect is looped.
Figure 53:
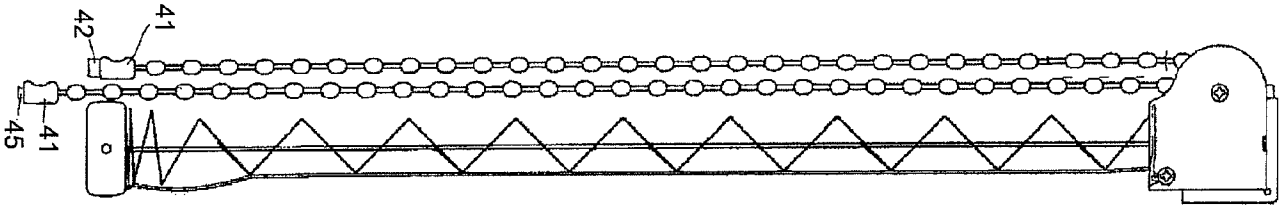
FIG. 53 is a side view showing a state where a ball chain of the ninth embodiment of the first aspect is unlooped.

During use of the blind, as shown in FIG. 52, by coupling the first coupling member 41 and the second coupling member 42 together, the ball chain 9 is used in a looped state. During nonuse of the blind, as shown in FIG. 53, the ball chain 9 can be unlooped by releasing the coupling between the first coupling member 41 and the second coupling member 42. Thus, the dweller can be prevent from tripping over the ball chain 9 and thus causing an accident. Further, the ball chain 9 can be easily attached or detached.

An effect specific to this embodiment is as follows: since the first coupling member 41 is formed with external dimensions such that the first coupling member 41 cannot pass between the pulley and the pulley case; accordingly, even in a state where the first coupling member 41 and the second coupling member 42 are uncoupled, the first coupling members 41 are disposed at both ends of the ball chain 9; and as a result, the ball chain 9 can be prevented from coming out of the pulley. Note that detaching the ball chain 9 from the pulley only requires taking the ball 15*b* out of the locking hole 82.

The above embodiment may be carried out in the following mode.

- The ball chain 9 may be a string cord provided with the balls 15*b* only at the ends thereof. Alternatively, the ball chain 9 may be cords as shown in the fifth to eighth embodiments.
- The fitting structure of the coupling portion 16 may be a structure as shown in the first, third, or fourth embodiment.

While the present invention has been described based on the various embodiments, the scope of the invention is not limited to these embodiments. Description made in an embodiment is applied to another embodiment without departing from the spirit of the present invention.

First Embodiment of Second Aspect

Figure 54:
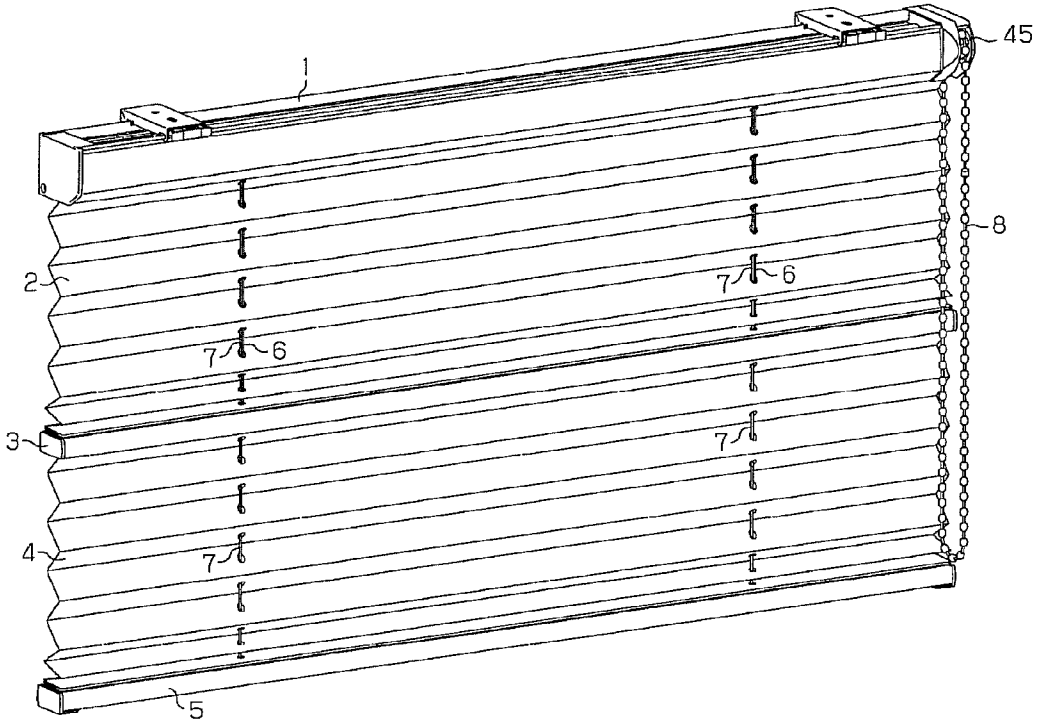
FIG. 54 is a perspective view showing a pleated screen of a first embodiment of a second aspect.

Hereafter, a first embodiment of a second aspect of the present invention will be described with reference to the drawings. In a pleated screen shown in FIG. 54, a top screen 2 is suspended and supported by the head box 1, and an intermediate rail 3 is attached to the bottom end of the top screen 2. A bottom screen 4 is suspended and supported by the intermediate rail 3, and a bottom rail 5 is attached to the bottom end of the bottom screen 4.

The top screen 2 is a semi-transparent texture, such as lace fabric, that can be folded in a zigzag manner; the bottom screen 4 is a texture having shading properties that can be folded in a zigzag manner.

A first hoisting cord 6 and a second hoisting cord 7 are inserted into portions adjacent to both ends in a width direction of the top screen 2, and the bottom end of the first hoisting cord 6 is attached to the intermediate rail 3. The second hoisting cord 7 penetrates through the intermediate rail 3 and is inserted into the bottom screen 4, and the bottom end thereof is attached to the bottom rail 5.

The respective top ends of the first hoisting cord 6 and the second hoisting cord 7 are supported by a screen elevator disposed in the head box 1. By operating an endless ball chain 8 suspended from a pulley 45 which is rotatably supported by an end of the head box 1, the intermediate rail 3 and the bottom rail 5 can be pulled up or down independently.

Specifically, by pulling down one side of the ball chain 8, the intermediate rail 3 is pulled up. By releasing the ball chain 8 with the intermediate rail 3 pulled up to the desired height, the stopper apparatus disposed in the head box 1 is activated to hold the intermediate rail 3 at the desired height. By pulling down one side of the ball chain 8 slightly in this state, the stopper apparatus is deactivated. Thus, the intermediate rail 3 can be lowered to the desired height by self-weight.

In contrast, by pulling down the other side of the ball chain 8, the bottom rail 5 is pulled up. By releasing the ball chain 8 from the hand with the bottom rail 5 pulled up to the desired height, the stopper apparatus disposed in the head box 1 is activated to hold the bottom rail 5 at the desired height. By pulling down one side of the ball chain 8 slightly in this state, the stopper apparatus is deactivated. Thus, the bottom rail 5 can be lowered to the desired height by self-weight.

Figure 55:
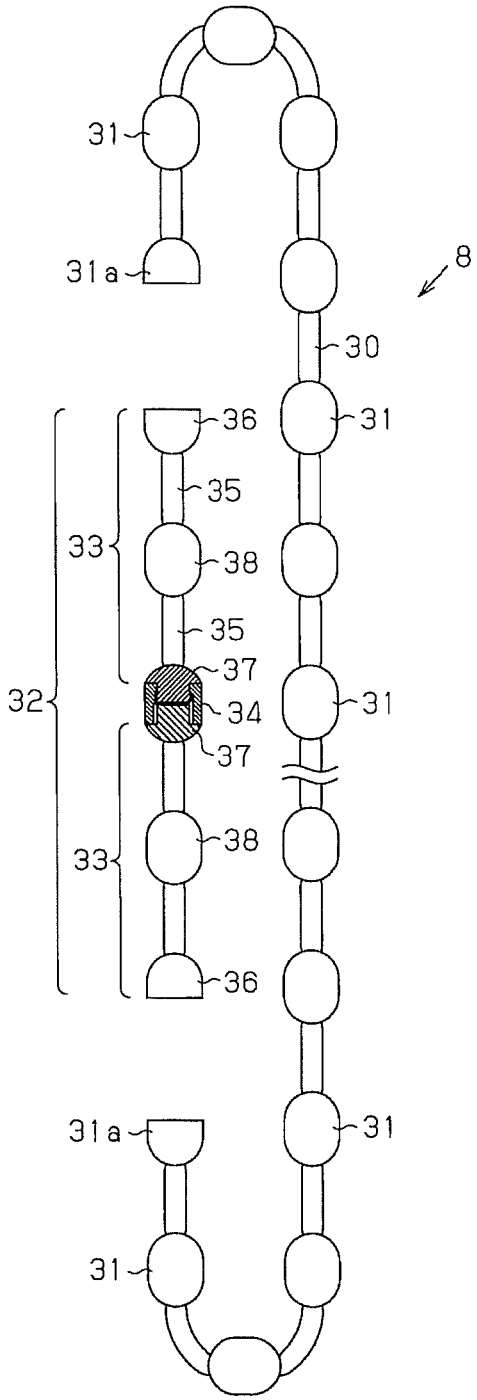
FIG. 55 is a front view showing a ball chain of the first embodiment of the second aspect.

Next, the specific configuration of the ball chain 8 will be described with reference to FIGS. 55 to 65. As shown in FIG. 55, in the ball chain 8, balls 31 formed of a synthetic resin are molded on a cord 30 formed of polyester at regular intervals. The balls 31 are subspherical solid bodies molded on a surface of the cord 30 by a molding machine and are fixed to the cord 30 so as to be immovable.

Figure 57:
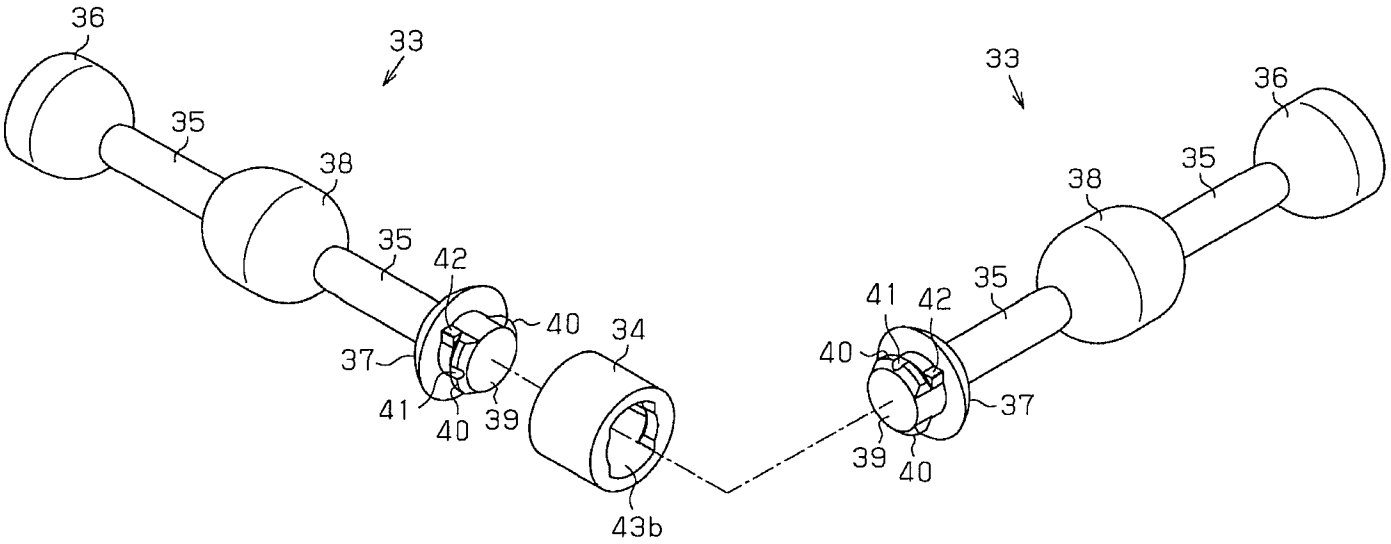
FIG. 57 is an exploded perspective view showing the coupling portion of the first embodiment of the second aspect.

By coupling both ends of the cord 30 together via the coupling portion 32, the endless ball chain 8 is formed. As shown in FIG. 57, the coupling portion 32 is configured such that the two first coupling members 33 of the same structure are coupled together via a tubular second coupling member 34.

In the first coupling member 33, a hemispheroid 36 having a shape of half the ball 31 is outsert-molded at an end of a coupling cord 35 made of the same material as that of the cord 30, and a first fitting part 37 is formed at the other end. A ball 38 having the same shape as the ball 31 is fixed between the hemispheroid 36 and the first fitting part 37. The interval between the first fitting part 37 and the ball 38 and the interval between the ball 38 and hemispheroid 36 are the same as the interval between the balls 31.

The hemispheroid 36 and the first fitting part 37 are formed of the same material as that of the ball 31 at both ends of the coupling cord 35. The base end of the first fitting part 37 is formed into a hemispheroid similar to the end of the ball 31. A round shank-shaped fitting protrusion is outsert-molded at the front end of the first fitting part 37.

Figure 58:
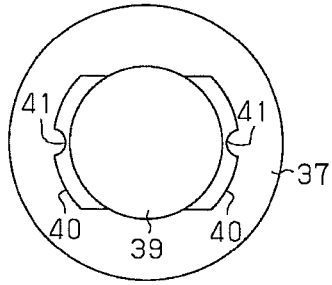
FIG. 58 is a side view showing a first coupling member of the first embodiment of the second aspect.

As shown in FIGS. 57 to 58, swelled portions 40 are formed on the outer peripheral surface of the front end of the fitting protrusion 39 so as to be line-symmetrical with respect to the center of the round shank, and troughs 41 (positioning means) having a semicircular cross-section are formed at the centers of the swelled portions 40.

Figure 59:
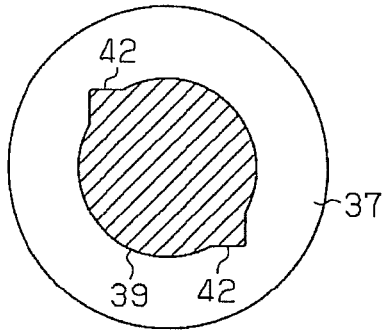
FIG. 59 is a sectional view showing the first coupling member of the first embodiment of the second aspect.

As shown in FIGS. 57 and 59, rotation-restriction portions 42 protruding in radial directions of the round shank are formed at the base end of the fitting protrusion 39 so as to be line-symmetrical with respect to the center of the round shank. The rotation-restriction portions 42 are formed at positions distant by 45 degrees from the troughs 41 in a circumferential direction with respect to the center of the fitting protrusion 39.

Figure 60:
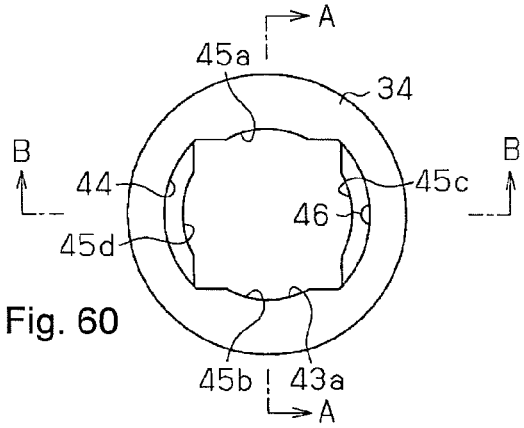
FIG. 60 is a side view showing a second coupling member of the first embodiment of the second aspect.
Figure 63:
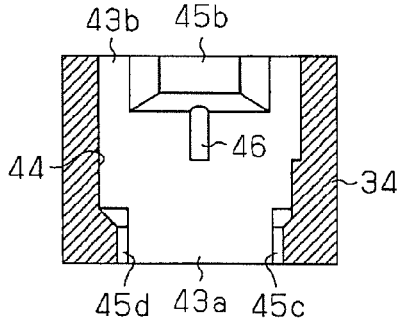
FIG. 63 is a sectional view taken along line B-B of FIG. 60.
Figure 61:
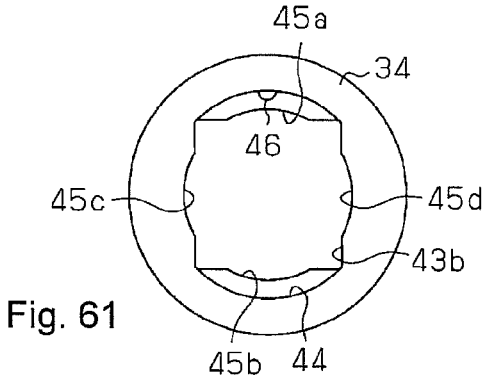
FIG. 61 is a side view showing the second coupling member of the first embodiment of the second aspect.
Figure 64:
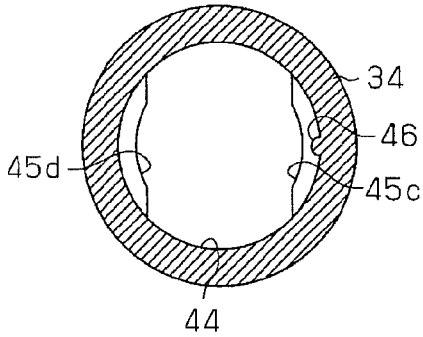
FIG. 64 is a sectional view taken along line C-C of FIG. 62.
Figure 62:
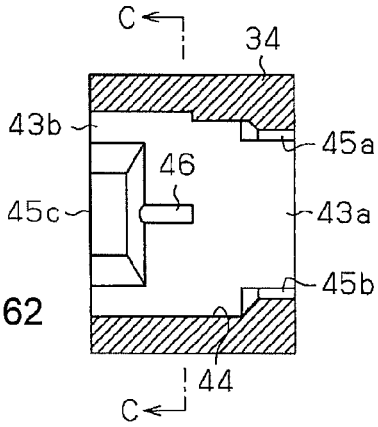
FIG. 62 is a sectional view taken along line A-A of FIG. 60.

The second coupling member 34 is molded into a tubular shape from the same synthetic resin as that of the first fitting part 37 and the balls 31,38. As shown in FIGS. 60 and 61, opening portions 43*a*, 43*b* on both sides of the second coupling member 34 are each formed into a bale shape into which the front end of the fitting protrusion 39, including the swelled portion 40, can be inserted. The opening portions 43*a*, 43*b* are so shaped that directions of the bale shapes are mutually rotated by 90 degrees with respect to the center of the tube.

A circular hole 44 having a diameter which allows the front end of the fitting protrusion 39 to rotate is formed inside the second coupling member 34. Locking portions 45*a*, 45*b* for preventing the swelled portion 40 from getting out of a circular hole 44 are formed at opening edges in a short-axis direction of the bale shape of the opening portion 43*a*. Locking portions 45*c*, 45*d* for preventing the swelled portion 40 from getting out of the circular hole 44 are formed at opening edges in a short-axis direction of the bale shape of the opening portion 43*b*.

Figure 65:
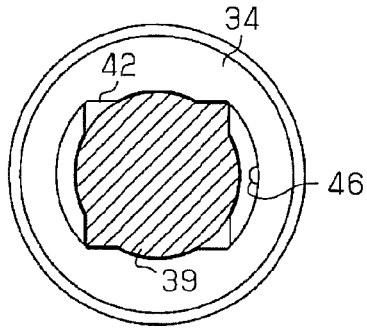
FIG. 65 is a sectional view showing the fit between the coupling members of the first embodiment of the second aspect.

Ridges 46 (positioning means) configured to engage with the troughs 41 are formed on the inner peripheral surface of the circular hole 44 inside the locking portions 45*a*, 45*c*. To coupling the first coupling member 33 and the second coupling member 34, the fitting protrusion 39 of the first fitting part 37 is inserted into one opening portion 43*a* of the second coupling member 34, and the first fitting part 37 is rotated clockwise by 90 degrees with respect to the second coupling member 34. Thus, the trough 41 of the fitting protrusion 39 engages with a ridge 46 in the circular hole 44, and the rotation-restriction portion 42 moves from a corner of the base shape of the opening portion 43*a* to an adjacent corner, achieving positioning as shown in FIG. 65.

Figure 56:
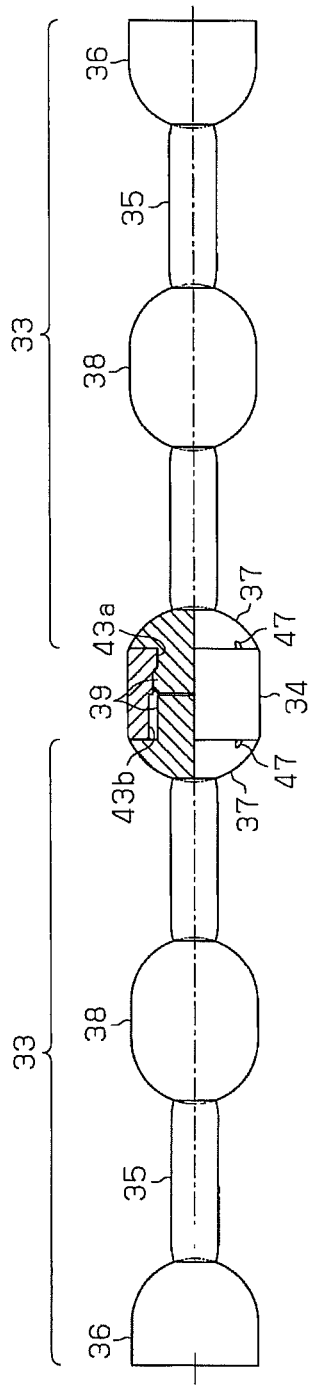
FIG. 56 is a front view showing a coupling portion of a ball chain of the first embodiment of the second aspect.

Similarly, positioning is performed by inserting the fitting protrusion 39 of the first coupling member 33 into the other opening portion 43*b* of the second coupling member 34 and rotating it by 90 degrees clockwise. Thus, as shown in FIGS. 55 and 56, the first coupling members 33 are coupled together via the second coupling member 34.

In this state, the swelled portions 40 of the fitting protrusions 39 of the first coupling member are engaged with the locking portions 45*a* to 45*d* of the second coupling member 34, and are held within the circular hole 44 of the second coupling member 34. The force for holding this engagement is set to a magnitude such that the fitting protrusion 39 is prevented from being uncoupled from the second coupling member 34 by a normal pull force applied when one side of the ball chain 8 is pulled down during a normal screen up/down operation. Only when the dweller or the like is caught on the ball chain 8 and a large pull force exceeding a normal pull force works on the ball chain 8 suspended from the pulley 45, the swelled portion 40 of the fitting protrusion 39 enlarges the opening portions 43*a*, 43*b* of the second coupling member 34 due to the resiliency of the second coupling member 34 formed of a synthetic resin. Thus, the fitting protrusion 39 is uncoupled from the second coupling member 34.

The hemispheroids 36 of the first coupling members 33 are welded and fixed to the hemispheroids 31*a* which are outsert-molded on both ends of the cord 30, forming balls of the same shape as that of the ball 31. By coupling the first coupling members 33 together via the second coupling member 34, the endless ball chain 8 is formed.

In the ball chain 8 thus configured, balls having the same shape are formed at regular intervals along the total length of the cord 30 of the ball chain 8 and the coupling cord 35 of the coupling portion 32. Therefore, the ball chain 8 can be rotated around the pulley unlimitedly.

As shown in FIG. 56, fitting marks 47 are formed on the first fitting part 37. The fitting marks 47 are recesses formed on the outer peripheral surfaces of the first fitting parts 37 near the contact surfaces between the first fitting parts 37 and the second coupling member 34.

By inserting the fitting protrusions 39 of the first coupling members 33 into the opening portions 43*a*, 43*b* at both ends of the second coupling member 34, rotating first fitting parts 37 of the first coupling members 33 with respect to the second coupling member 34 by 90 degrees in reverse directions to ensure a fit, the positions of the fitting marks 47 are aligned in a circumferential direction of the second coupling member 34 and opposed to each other.

The pleated screen thus configured can show the following effects.

(1) When the dweller or the like is caught by the ball chain 8, the first coupling member 33 and the second coupling member 34 of the coupling portion 32 are uncoupled. As seen, the ball chain 8 can have a fail-safe function.

(2) By fitting the first coupling member 33 into the second coupling member 34 again after they are uncoupled, the endless ball chain 8 can be reconstructed easily.

(3) To fit the first coupling members 33 into both sides of the second coupling member 34, the first coupling members 33 are rotated to positions where the fitting marks 47 of the first coupling members 33 are aligned in the circumferential direction of the second coupling member 34 and opposed to each other. Thus, it is possible to reliably fit the first coupling members 33 into the second coupling member 34 to couple the first coupling members 33 together via the second coupling member 34. Further, by checking the positions of the fitting marks 47, it can be checked whether the first coupling members 33 and the second coupling member 34 are reliably fitted with each other.

Second Embodiment of Second Aspect

Figure 66:
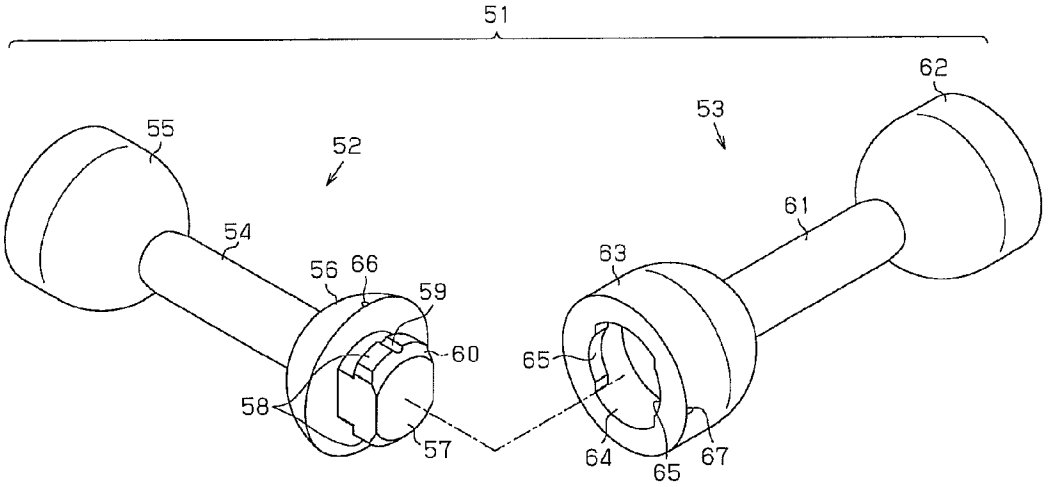
FIG. 66 is an exploded perspective view showing the coupling portion of the second embodiment of the second aspect.

FIG. 66 shows a second embodiment. In this embodiment, the coupling portion of a ball chain differs from that of the first embodiment in configuration and is provided with fitting marks.

A coupling portion 51 of a ball chain is composed of a first coupling member 52 and a second coupling member 53. In the first coupling member 52, a hemispheroid 55 having a shape of half the ball 38 is outsert-molded at an end of a coupling cord 54, and a first fitting part 56 is formed at the other end. The interval between the hemispheroid 55 and the first fitting part 56 is the same as the interval between the balls 31.

The base end of the first fitting part 56 is formed into a hemispheroid similar to that of the end of the ball 31. Formed at the front end thereof is a fitting protrusion 57 having a bale-shaped cross-section obtained by cutting off both sides of a round shank in parallel.

Formed at the front end of the fitting protrusion 57 is a swelled portion 58 having a diameter swelled in the long axis direction of the bale shape. Troughs 59 are formed on the outer peripheral surfaces of both sides in the long axis direction of the swelled portion 58 in the axis direction of the first fitting part 56. Formed at the corner of the swelled portion 58 is a chamfered edge 60.

In the second coupling member 53, a hemispheroid 62 having a shape of half the ball 31 is formed at an end of a coupling cord 61, and a second fitting part 63 is formed at the other end. The hemispheroid 62 and the second fitting part 63 are molded from the same synthetic resin as that of the ball 31, and the interval between the hemispheroid 62 and the second fitting part 63 is the same as the interval between the balls 31.

The base end of the second fitting part 63 is formed into a hemispheroid shape similar to the end of the ball 31, and a fitting hole 64 is formed at the center of the front end surface of the second fitting part 63. The fitting hole 64 has a bale-shaped opening portion into which the swelled portion 58 of the fitting protrusion 57 can be inserted.

The deep section of the fitting hole 64 is formed into a circle having a diameter that allows the fitting protrusion 57 to rotate in the fitting hole 64. Accordingly, locking portions 65 configured to engage with the swelled portion 58 are formed at the opening portion of the fitting hole 64. An opening edge of each locking portion 65 is gouged into an arc so that the base portion of the fitting protrusion 57 can rotate.

A ridge (not shown) that can engage with the trough 59 when the fitting protrusion 57 is inserted into the fitting hole 64 and rotated by 90 degrees is formed on one side of the inner peripheral surface of the deep section of the fitting hole 64.

Fitting marks 66, 67 are formed on the first fitting part 56 and the second fitting portion 63. The fitting marks 66, 67 are recesses formed on the outer peripheral surfaces of the first fitting part 56 and the second fitting part 63 near the contact surface between the first fitting part 56 and the second fitting part 63.

By inserting the fitting protrusion 57 of the first fitting part 56 into the fitting hole 64 of the second fitting part 63 and rotating the first fitting part 56 with respect to the second fitting part 63 by 90 degrees to ensure a fit, the positions of the fitting marks 66, 67 are aligned in the circumferential direction of the first fitting part 56 and the second fitting part 63 and opposed to each other.

To couple the first fitting part 56 and the second fitting part 63 configured as described above, the swelled portion 58 of the fitting protrusion 57 is inserted into the fitting hole 64, and the first fitting part 56 is rotated by 90 degrees in either direction in this status. As a result, the trough 59 of the swelled portion 58 is engaged with the ridge 36 in the fitting hole 64, achieving positioning. Thus, the swelled portion 58 is engaged with the locking portion 65 and held within the fitting hole 64.

The force for holding this engagement is set to a magnitude such that the fit between the fitting protrusion 57 and fitting hole 64 is not released by a normal pull force applied to the ball chain 8 in a usual up/down operation and slat angle adjustment operation. Only when a great pull force that exceeds the normal pull force is applied to the ball chain 8, the opening portion of the fitting hole 64 is enlarged by the resiliency of the synthetic resin and thus the swelled portion 58 is pulled out of the fitting hole 64. As a result, the fit between the fitting protrusion 57 and the fitting hole 64 is released.

The hemispheroids 55, 62 of the first coupling member 52 and the second coupling member 53 are welded and fixed to the hemispheroids 31*a* which are outsert-molded on both ends of the cord 30, forming balls of the same shape as that of the ball 31. By fitting the fitting protrusion 57 into the fitting hole 64, the endless ball chain 8 is formed.

The ball chain thus configured can show the following effects.

(1) By fitting the fitting protrusion 57 into the fitting hole 64 again after the fit between the fitting part 56 and the fitting part 63 of the coupling portion 51 is released, the endless ball chain 8 can be reconstructed easily.

(2) A configuration is adopted where the fitting protrusion 57 is fitted into the fitting hole 64 by inserting the swelled portion 58 of the fitting protrusion 57 into the fitting hole 64 and then rotating the swelled portion 58 by 90 degrees. As a result, it is possible to obtain a sufficient holding force to hold the fitting protrusion 57 within the fitting hole 64 while minimizing the operation force for fitting the fitting protrusion 57 into the fitting hole 64.

(3) Since the operation force for fitting the fitting protrusion 57 into the fitting hole 64 is minimized, it is possible to fit the fitting protrusion 57 into the fitting hole 64 again without using a tool. Therefore, if the coupling portion 51 is uncoupled, the dweller can easily restore the fit.

(4) When the first fitting part 56 is fitted into the second fitting part 63 by rotating the first fitting part 56 by 90 degrees, the positions of the fitting marks 66, 67 are aligned in the circumferential direction of the first fitting part 56 and the second fitting part 63 and opposed to each other. Thus, it can be checked whether the first fitting part 56 and the second fitting part 63 are securely fitted with each other.

The above embodiment may be carried out in the following mode.

The fitting marks of this embodiment may be protrusions.

The coupling portions 32,51 may be used as the coupling portion of an endless operation cord for a sunlight shielding apparatus.

The coupling portions 32,51 having a fail-safe function may be provided in the midpoint of a hoisting cord or operation cord which is suspended from the head box of a horizontal blind and coupled to a bottom rail.

The hemispheroid 36 may be bonded to the hemispheroid 31*a* using an adhesive.

First Embodiment of Third Aspect

Hereafter, a first embodiment of a third aspect of the present invention will be described with reference to the drawings. The basic configurations of a pleated screen and ball chain of this embodiment are as described in the first embodiment of the second aspect. Hereafter, the differences between this embodiment and the first embodiment of the second aspect will be mainly described.

Figure 67:
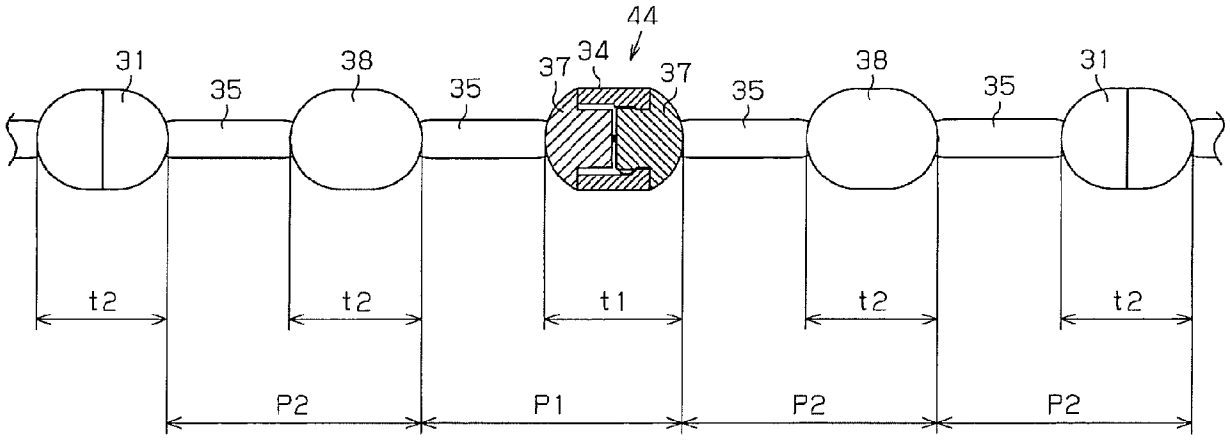
FIG. 67 is a front view showing a coupling portion of a ball chain of a first embodiment of a third aspect.

As shown in FIG. 67, when the first fitting part 37 of the first coupling member 33 is fitted into the second coupling member 34, a coupling ball 44 having a subspherical shape similar that of the balls 31, 38 is formed. The coupling ball 44 is formed with a long diameter t1 which is larger than a long diameter t2 of other balls 31, 38. For example, the t1 is set to 6.5 mm; t2 is set to 6.2 mm.

Due to the different between the long diameters, a pitch p1 between the coupling ball 44 and an adjacent ball 38 is set to 12.3 mm; and a pitch p2 between other balls 38,31 and between the balls 31 is 12.0 mm.

Figure 68:
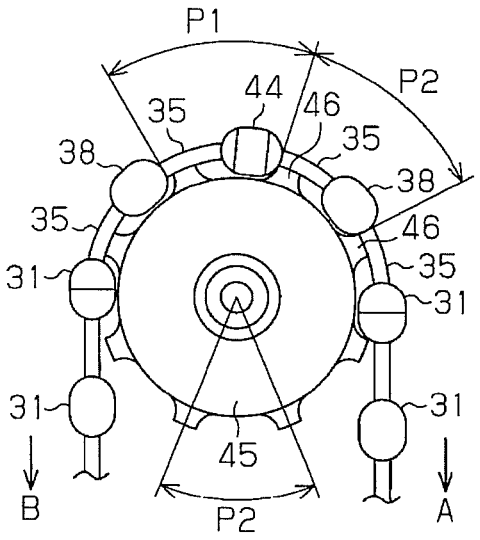
FIG. 68 is a front view showing a ball chain engaged with a pulley of the first embodiment of the third aspect.

As shown in FIG. 68, the engaging protrusions 46 for engaging with the balls 31, 38 and the coupling ball 44 are formed at regular intervals on the outer peripheral surface of the pulley 45 with which the ball chain 8 engages, and the pitch between the engaging protrusions 46 is set to 12.0 mm, which is the same as the pitch p2.

In the ball chain 8 thus configured, the balls 31, 38, 44 having approximately the same shape are formed along the total length of the cord 30 of the ball chain 8 and the coupling cord 35 of the coupling portion 32. As a result, the ball chain 8 can be rotated around the pulley 45 unlimitedly.

Next, effects of the ball chain 8 thus configured will be described. By operating the ball chain 8 to rotate the pulley 45 in one or the other direction, an elevator in the head box 1 is activated to raise or lower the top screen 2 or bottom screen 4.

Figure 69:
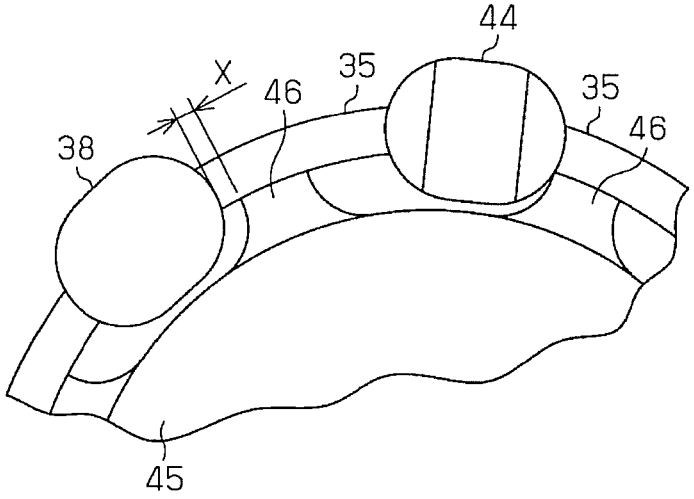
FIG. 69 is an enlarged view showing a coupling portion of the ball chain engaged with the pulley of the first embodiment of the third aspect.

As shown in FIG. 68, when the ball chain 8 is pulled toward an arrow A in a normal operation and the coupling ball 44 is engaged with the engaging protrusion 46 of the pulley 45, a gap x is generated between the following ball 38 and engaging protrusion 46, as shown in FIG. 69. This is because that the pitch p1 between the coupling ball 44 and the following ball 38 is larger than the pitch p2 between the engaging protrusions 46.

When the coupling ball 44 is engaged with the engaging protrusion 46 of the pulley 45, the following ball 38 does not abut on the engaging protrusion 46. Accordingly, the abutment of the following ball 38 on the engaging protrusion 46 does not apply a pull force to the coupling ball 44. This prevents a force for pulling the coupling ball 44 to both sides from working on the coupling ball 44. Accordingly, the coupling between the first coupling member 33 and the second coupling member 34 is not released. The same goes for a case where the ball chain 8 is pulled toward an arrow B.

When the ball chain 8 is caught on the dweller or the like, an excessive pull force work on the ball chain 8 suspended from the pulley 45 in the directions of the arrows A, B. The first coupling member 33 and the second coupling member 34 are uncoupled regardless of whether the coupling ball 44 is engaged with the pulley 45. Accordingly, movement of the dweller or the like is not obstructed.

The pleated screen operation apparatus thus configured can show the following effects.

(1) When the dweller or the like is caught on the ball chain 8, the first coupling member 33 and the second coupling member 34 of the coupling portion 32 are uncoupled. Accordingly, the ball chain 8 can have a fail-safe function.

(2) By fitting the first coupling member 33 into the second coupling member 34 again after they are uncoupled, the endless ball chain 8 can be reconstructed easily.

(3) When the coupling ball 44 is engaged with the pulley 45 during a normal operation, useless uncoupling between the first coupling member 33 and the second coupling member 34 can be prevented.

The above embodiment may be carried out in the following mode.

The diameter of the coupling ball 44 may be the same as that of the other balls 31, 38. The pitch p1 may be made longer than the pitch p2 by making the length of the coupling cord 35 between the coupling ball 44 and the adjacent ball 38 longer than the length of the coupling cord between other balls.

The diameter of the coupling ball 44 may be made larger than that of the other balls 31, 38. The pitch p1 may be made longer than the pitch p2 by making the length of the coupling cord 35 between the coupling ball 44 and the adjacent ball 38 longer than the length of the coupling cord between other balls.

The hemispheroid 36 may be bonded to the hemispheroid 31*a* using an adhesive.

This embodiment is also applicable to ball chains used as an operation apparatus for a horizontal blind or roller blind.

DESCRIPTION OF NUMERALS (Numerals in First Aspect)

9 . . . ball chain; 12 . . . pulley; 14,14*a* . . . main cord; 15,15*b*,44 . . . ball; 15*a*,20,24 . . . hemispheroid; 16 . . . coupling portion; 17,27,41 . . . first coupling member; 18,28,42 . . . second coupling member; 19 . . . coupling cord; 21,29 . . . first fitting part; 30,45 . . . fitting protrusion; 23 . . . coupling cord; 34 . . . second fitting part; 35,75 . . . fitting hole; 72 . . . fitting recess; 74 . . . axis; 76 . . . opening groove; 77 . . . insertion hole; 81 . . . locking hole; 82 . . . locking hole; 83 . . . insertion hole; 84 . . . guide groove; 98 . . . operation cord; 99 . . . docking portion (Numerals in Second and Third Aspects)

1 . . . head box; 2,4 . . . shielding material (top screen; bottom screen); 8 . . . cord (ball chain); 31,38 . . . ball; 32 . . . coupling portion; 33,52 . . . first coupling member; 34,53 . . . second coupling member; 39 . . . fitting protrusion; 43*a*, 43*b* . . . fitting hole (opening portion); 44 . . . coupling ball; 45 . . . pulley; 47,66,67 . . . indication means (fitting mark); p1,p2 . . . pitch

The invention claimed is:

1. An operation cord comprising:

a main cord having one and the other ends, the main cord having a length direction defined between the one and the other ends;

a first coupling part disposed at the one end; and a second coupling part disposed at the other end, the first and second coupling part being formed of a synthetic resin, wherein the first and second coupling parts configured to be coupled together directly or via a coupling member formed of a synthetic resin and configured to be coupled or uncoupled by means of a relative rotation between the adjacent coupling parts, or a relative rotation between the adjacent coupling parts and coupling member, wherein balls formed of a synthetic resin are disposed on the main cord at regular intervals, and when the first and second coupling parts are directly coupled, the first and second coupling parts in combination, form substantially the same shape and size as that of the ball, and when the first and second coupling parts are coupled via the coupling member, the first and second coupling parts and the coupling member in combination form substantially the same shape and size as that of the ball, the first coupling part and the second coupling part are configured to be separatable by resilient deformation of the synthetic resin of at least one of the first coupling part, the second coupling part, or the coupling member, which is caused by a second pull force applied to the operation cord substantially along the length direction without relative rotation between the adjacent coupling parts or relative rotation between the adjacent coupling parts and coupling member, the second pull force exceeding a first pull force applied to the operation cord on normal operation.

2. The operation cord of claim 1, wherein the first coupling part comprises an axial fitting protrusion, the second coupling part has a fitting hole into which the fitting protrusion can be fitted, and the fitting protrusion can be fitted into the fitting hole by inserting the fitting protrusion into the fitting hole and then rotating the fitting protrusion.

3. The operation cord of claim 2, wherein the fitting protrusion comprises a swelled portion having a diameter larger than a diameter of a base end thereof, and the fitting hole is provided with a locking portion configured to engage with the swelled portion.

4. The operation cord of claim 1, wherein one or both of the first and second coupling parts have a color different from a color of the main cord.

5. The operation cord of claim 1, wherein the first coupling part comprises an axial fitting protrusion, the second coupling part has a fitting hole into which the fitting protrusion can be fitted, the fitting protrusion can be fitted into the fitting hole by inserting the fitting protrusion into the fitting hole and then rotating the fitting protrusion, and the first coupling part is provided with indication means configured to indicate that the fitting protrusion is fitted into the fitting hole.

6. The operation cord of claim 5, wherein the first and second coupling parts are molded from a synthetic resin, the second coupling part is formed in the form of a tube into which the fitting protrusions of the first coupling parts forming a pair can be fitted from both sides of the tube, the first and second coupling parts are each provided with positioning means configured to position the fitting protrusion at a fitting position, and the first coupling parts are provided with fitting marks as the indication means, the fitting marks being positioned so as to be opposed to each other in a positioning operation using the positioning means.

7. The operation cord of claim 6, wherein the fitting marks are recesses formed near contact surfaces between the first coupling parts and the second coupling part on respective outer peripheral surfaces of the first coupling parts.

8. The operation cord of claim 5, wherein the first and second coupling parts are molded from a synthetic resin, the first and second coupling parts are each provided with positioning means configured to position the fitting protrusion at a fitting position, and the first and second coupling parts are provided with fitting marks, respectively, as the indication means, the fitting marks being positioned so as to be opposed to each other in a positioning operation using the positioning means.

9. The operation cord of claim 8, wherein the fitting marks are recesses formed near contact surfaces between the first and second coupling parts on respective outer peripheral surfaces of the first and second coupling parts.

10. An operation apparatus for a sunlight shielding apparatus where an endless operation cord is suspended from a pulley which is rotatably supported by a head box; and the pulley is rotated on the basis of an operation of the operation cord to drive a shading material, wherein the operation cord is the operation cord of claim 1 and is an endless ball chain coupled via a coupling ball having a fail-safe function, and a pitch between the coupling ball and a ball adjacent to the coupling ball is larger than a pitch between other balls.

11. The operation cord for a sunlight shielding apparatus of claim 10, wherein a pitch between protrusions of the pulley is the same as a pitch between balls of the ball chain, and the pitch between the coupling ball and the ball adjacent to the coupling ball is made larger than the pitch between the other balls.

12. The operation cord for a sunlight shielding apparatus of claim 11, wherein the pitch between the coupling ball and the ball adjacent to the coupling ball is made larger than the pitch between the other balls by increasing a length of a coupling cord coupling the coupling ball and the ball adjacent to the coupling ball.

* * * * *